United States Patent [19]

Shiina et al.

[11] Patent Number: 4,989,556

[45] Date of Patent: Feb. 5, 1991

[54] VALVE SPRING RETAINER FOR VALVE OPERATING MECHANISM FOR INTERNAL COMBUSTION ENGINE

[75] Inventors: Haruo Shiina; Masami Hoshi; Tadayoshi Hayashi, all of Saitama, Japan

[73] Assignee: Honda Giken Kogyo Kabushiki Kaisha, Tokyo, Japan

[21] Appl. No.: 414,692

[22] Filed: Sep. 28, 1989

[30] Foreign Application Priority Data

| | | | |
|---|---|---|---|
| Oct. 7, 1988 | [JP] | Japan | 63-253373 |
| Oct. 7, 1988 | [JP] | Japan | 63-253374 |
| Oct. 11, 1988 | [JP] | Japan | 63-255627 |
| Oct. 11, 1988 | [JP] | Japan | 63-255697 |

[51] Int. Cl.[5] ..... F01L 3/10

[52] U.S. Cl. ..... 123/90.67; 123/90.51

[58] Field of Search ..... 123/90.51, 90.67

[56] References Cited

U.S. PATENT DOCUMENTS

| | | | |
|---|---|---|---|
| 4,230,491 | 10/1980 | Behnke | 123/90.51 |
| 4,432,311 | 2/1984 | Holtzberg et al. | 123/90.67 |
| 4,483,286 | 11/1984 | Hermann et al. | 123/193 P |
| 4,665,869 | 5/1987 | Hinz et al. | 123/90.67 |
| 4,834,941 | 5/1989 | Shiina | 420/532 |
| 4,856,469 | 8/1989 | Okazaki et al. | 123/90.51 |
| 4,873,150 | 10/1989 | Doi et al. | 123/90.51 |

FOREIGN PATENT DOCUMENTS 2167442 5/1986 United Kingdom .

*Primary Examiner*—Charles J. Myhre
*Assistant Examiner*—Weilun Lo
*Attorney, Agent, or Firm*—Lyon & Lyon

[57] ABSTRACT

A valve spring retainer for a valve operating mechanism for an internal combustion engine comprises a matrix formed from a quenched and solidified aluminum alloy powder, and a hard grain dispersed in said matrix. The hard grain is at least one selected from the group consisting of grains of $Al_2O_3$, SiC, $Si_3N_4$, $ZrO_2$, $SiO_2$, $TiO_2$, $Al_2O_3$-$SiO_2$ and metal Si. The amount of hard grain added is in a range of 0.5% to 20% by weight, and the area rate of said hard grain is in a range of from 1% to 6%.

39 Claims, 7 Drawing Sheets

VALVE SPRING RETAINER FOR VALVE OPERATING MECHANISM FOR INTERNAL COMBUSTION ENGINE

BACKGROUND OF THE INVENTION

1. Field of the Invention

The field of the present invention is valve spring retainers for valve operating mechanisms for internal combustion engines, and particularly, lightweight valve spring retainers formed from aluminum alloys.

2. Description of the Prior Art

Such valve spring retainers have been conventionally made using a high strength aluminum alloy containing large amounts of Si, Fe, Mn, etc., added thereto, by utilizing a powder metallurgical technique.

However, the above aluminum alloy is accompanied by a problem: An initial crystal Si, an eutectic crystal Si, an intermetallic compound, etc., precipitated therein are very fine and hence, the resulting valve spring retainer may be subject to a large amount of slide wear and as a result, has a lacking durability under a higher surface pressure and under a rapid sliding movement.

There is also such a known valve spring retainer which includes a flange portion at one end of an annular base portion that has a diameter larger than the base portion, with an annular end face of the flange portion serving as an outer seat surface for carrying an outer valve spring and with an annular end face of the base portion serving as an inner seat surface for carrying an inner valve spring.

The valve spring retainer is produced utilizing a powder metallurgical technique and hence, the structure and the hard grain dispersion in a surface layer region having the outer seat surface are substantially identical with those in a surface layer region having the inner seat surface.

In the above valve operating mechanism, the outer valve spring has a relatively high preset load, while the inner valve spring has a relatively low preset load. Therefore, in the valve spring retainer, the slide surface pressure on the outer seat surface is larger than that on the inner seat surface. Under such a situation, and if properties of the outer and inner seat surfaces are the same, a difference in the amount of wear will be produced between the two seat surfaces, thereby bringing about a variation in load distribution between the outer and inner valve springs.

In addition, because a valve spring retainer is disposed in a limited space in the valve operating system, it is designed so that the thickness of the flange portion may be decreased to reduce the amount of projection in the direction of its valve stem. Therefore, there is a tendency to generate a concentration of stress at the junction between the flange portion and the base portion. Accordingly, it is desired to improve the fatigue strength of such junction.

Further, if hydrogen gas is included in the aluminum alloy, the fatigue strength thereof is damaged. Therefore, it is a conventional practice to subject a powder compact to a degassing treatment, but this treatment may causes not only a reduction in production efficiency for the valve spring retainer, but also a fear of damaging the strength thereof.

SUMMARY OF THE INVENTION

It is an object of the present invention to provide a valve spring retainer made of an aluminum alloy and improved in wear resistance, strength and the like.

To attain the above object, according to the present invention, there is provided a valve spring retainer for a valve operating mechanism for an internal combustion engine, comprising a matrix formed from a quenched and solidified aluminum alloy powder, and a hard grain dispersed in the matrix, the hard grain being at least one selected from the group consisting of grains of $Al_2O_3$, SiC, $Si_3N_4$, $ZrO_2$, $SiO_2$, $TiO_2$, $Al_2O_3$-$SiO_2$ and metal Si, the amount of hard grain added being in a range of from 0.5% to 20% by weight, and the area rate of the hard grain being in a range of 1% to 6%.

In addition, according to the present invention, there is provided a valve spring retainer for a valve operating mechanism for an internal combustion engine, comprising a matrix formed from a quenched and solidified aluminum alloy powder containing 12.0% to 28.0% by weight of Si; 0.8% to 5.0% by weight of Cu; 0.3% to 3.5% by weight of Mg; 2.0% to 10.0% by weight of Fe; and 0.5% to 2.9% by weight of Mn.

Further, according to the present invention, there is provided a valve spring retainer for a valve operating mechanism for an internal combustion engine, comprising a flange portion at one end of an annular base portion that has a diameter larger than that of the base portion, with an annular end face of the flange portion serving as an outer seat surface for carrying an outer valve spring and an annular end face of the base portion serving as an inner seat surface for carrying an inner valve spring, so that the flow pattern of the fiber structure of the material in a surface region having the outer seat surface is substantially parallel to the outer seat surface.

Yet further, according to the present invention, there is provided a valve spring retainer for a valve operating mechanism for an internal combustion engine, formed from a quenched and solidified aluminum alloy containing 0.2% to 4% by weight of at least one hydride forming constituent selected from the group consisting of Ti, Zr, Co, Pd and Ni.

If the amount of hard grain added and the area rate of the hard grain are specified, the dispersion of the hard grain in the matrix is optimal for improving the wear resistance of the matrix. In addition, the hard grain has an effect of fixing the dislocation of the crystal of the matrix to provide improvements in creep characteristic, stress corrosion and crack resistance, a reduction in thermal expansion coefficient, and improvements in Young's modulus and fatigue strength.

However, if the hard grain content is less than 0.5% by weight, the wear resistance is not improved, and the degrees of the improvement in Young's modulus and the decrease in thermal expansion coefficient are also lower. On the other hand, if the hard grain content is more than 20%, e.g., 25.0% by weight, the wearing of the valve spring is increased.

If the area rate of the hard grain is less than 1%, the wear resistance is insufficient. On the other hand, any area rate exceeding 6% will cause a deterioration of the stress corrosion and crack resistance and a reduction in fatigue strength.

The reason why each constituent is contained and the reason why the content thereof is limited are as follows:

(a) For Si

Si has an effect of improving the wear resistance, the Young's modulus and the thermal conductivity of the matrix and decreasing the thermal expansion coefficient of the matrix. However, If the amount of Si is less than 12.0% by weight, the above effect cannot be obtained. On the other hand, if the amount of Si is more than 28.0% by weight, the formability is degraded in the extruding and forging steps, resulting in the likelihood that cracks will be produced.

(b) For Cu

Cu has an effect of reinforcing the matrix in the thermal treatment. However, if the amount of Cu is less than 0.8% by weight, such effect cannot be obtained. On the other hand, if the amount of Cu is more than 5.0% by weight, the stress corrosion and crack resistance is degraded and the hot forging workability is reduced.

(c) For Mg

Mg has an effect of reinforcing the matrix in the thermal treatment as Cu does. However, if the amount of Mg is less than 0.3% by weight, such effect cannot be obtained. On the other hand, if the amount of Mg is more than 3.5% by weight, the stress corrosion and crack resistance is degraded and the hot forging workability is reduced.

(d) For Fe

Fe has an effect of improving the high-temperature strength and Young's modulus of the matrix. However, if the amount of Fe is less than 2.0% by weight, an improvement in high-temperature strength cannot be expected. On the other hand, if the amount of Fe is more than 10.0% by weight, the rapid hot forging is actually impossible.

(e) For Mn

Mn has an effect of improving the high-temperature strength and the stress corrosion and crack resistance of the matrix and enhancing the hot forging workability in a range of Fe≧4%. If the amount of Mn is less than 0.5%, however, such effect cannot be obtained. On the other hand, if the amount of Mn is exceeds 2.0% by weight, adverse influences arise, and for example, the hot forging workability is rather degraded.

The hard grain particles are linearly arranged along the flow pattern of the fiber structure in the outer seat surface and hence, the area rate of the hard grain on the outer seat surface is higher. This improves the wear resistance of the outer seat surface.

Further, the hydrogen gas in the aluminum alloy can be fixed in the form of a hydride, so that the fatigue strength of such alloy and thus the valve spring retainer can be improved. In addition, because this alloy cannot be limited by the amount of hydrogen gas, there is no need to consider the degassing treatment. Therefore, in producing the alloy, it is possible to employ a powder direct-forming process comprising a powder pressing step directly followed by a forging step rather than comprising a powder pressing step, an extruding step and a forging step which are conducted in sequence. This makes it possible to simplify the production of an alloy to improve the mass productivity thereof.

However, if the content of the hydride forming constituent is less than 0.2% by weight, the hydride forming action is declined. On the other hand, any content of the hydride forming constituent exceeding 4% by weight will result in a problem of reductions in elongation and toughness.

The above and other objects, features and advantages of the invention will become apparent from a reading of the following detailed description of the preferred embodiments, taken in conjunction with the accompanying drawings.

DESCRIPTION OF THE PREFERRED EMBODIMENTS

Figure 1:
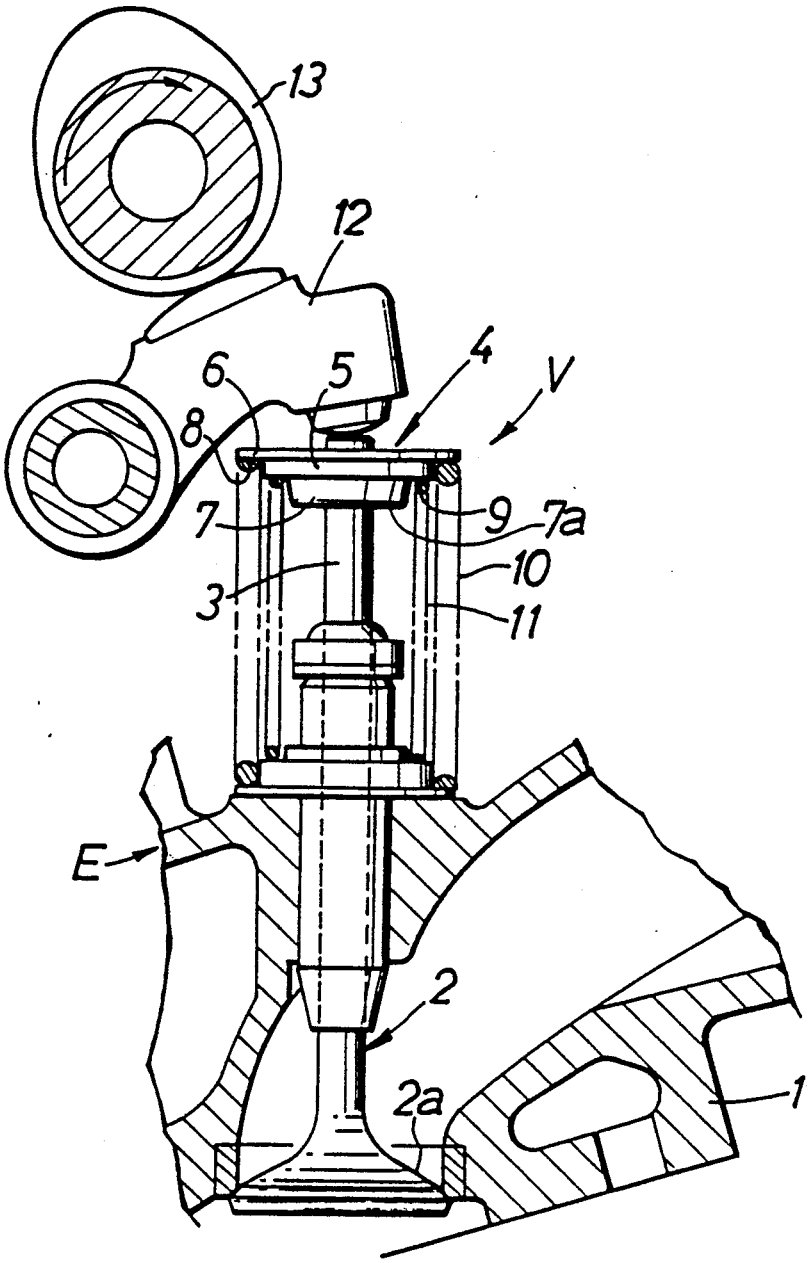
FIG. 1 is a sectional view of a valve operating mechanism for an internal combustion engine.

FIG. 1 illustrates a valve operating mechanism V for an internal combustion engine E, in which a valve spring retainer 4 is secured to a leading end of a valve stem 3 of an intake valve 2 slidably mounted in a cylinder head 1. The valve spring retainer 4 comprises an annular base portion 5, a flange portion 6 located at one end of the base portion 5, an annular projection 7 located at the other end of the base portion 5. The flange portion 6 is larger in diameter and smaller in thickness than the base portion 5. The projection 7 is smaller in diameter than the base portion 5 and has its outer peripheral surface formed into a tapered surface convergent toward an outer end face 7*a*. An annular end face of the flange portion 6 is an outer seat surface 8, and an annular end face of the base portion 5 is an inner seat surface 9. Thus, the projection 7 projects from an inner peripheral edge of the inner seat surface 9.

An outer valve spring 10 is carried at one end thereof on the outer seat surface 8, and an inner valve spring 11 is carried at one end thereof on the inner seat surface 9. In this case, the outer valve spring 10 has a relatively large preset load, while the inner valve spring 11 has a relatively small preset load. In Figure, the reference numeral 12 is a rocker arm, and the numeral 13 is cam shaft.

The valve spring retainer 4 will be described below in detail.

First, for a quenched and solidified aluminum alloy powder for forming a matrix to make a material for the valve spring retainer 4, a powder was produced utilizing an atomizing process, which consists of 14.5% by weight of Si, 2.5% by weight of Cu, 0.5% by weight of Mg, 4.5% by weight of Fe, 2.0% by weight of Mn, and the balance of Al including unavoidable impurities.

Grains of $Al_2O_3$, SiC, $Si_3N_4$, $ZrO_2$, $SiO_2$, $TiO_2$, $Al_2O_3$-$SiO_2$, and metal Si were prepared as hard grains, and a hard grain mixture was produced by selecting the following grains from these prepared grains.

| | |
|---|---|
| $Al_2O_3$ grain | 48.5% by weight |
| $ZrO_2$ grain | 30.2% by weight |
| $SiO_2$ grain | 20.0% by weight |
| $TiO_2$ grain | 1.3% by weight |

Aluminum alloys $a_1$ to $a_3$ having area rates of the hard grain mixture given in Table 1 were produced by blending the hard grain mixture with the aluminum alloy powder through individual steps which will be described hereinbelow.

The aluminum alloy powder and the hard grain mixture were blended in a V-shaped blender, and the individual blended powders were then subjected to a cold isostatic pressing process (CIP process) to provide powder compacts. Then, the individual powder compacts were placed into a uniform heat oven and left therein for a predetermined time. Thereafter, they were subjected to a hot extrusion to provide the aluminum alloys $a_1$ to $a_3$ each formed into a rounded bar and having a diameter of 20.5 mm and a length of 400 mm.

Each of these aluminum alloys $a_1$ to $a_3$ is used for a material for the valve spring retainer according to the present invention, and the above-described diameter thereof is substantially equal to that of the base portion 5.

For comparison, alloys $b_1$ and $b_2$ of Comparative Examples having area rates of hard grain mixture given in Table I were produced by blending the hard grain mixture to an aluminum alloy of the same composition as described above and through the same steps as the above-described steps.

TABLE I

| Aluminum alloy | Area rate (%) | Ratio of area rates |
|---|---|---|
| $a_1$ | 1 | 1.1 |
| $a_2$ | 3 | 1.5 |
| $a_3$ | 8 | 1.4 |
| $b_1$ | 0.2 | 1.04 |
| $b_2$ | 0.4 | 1.04 |

In Table I, the ratio of the area rates was determined in the following manner.

Figure 2:
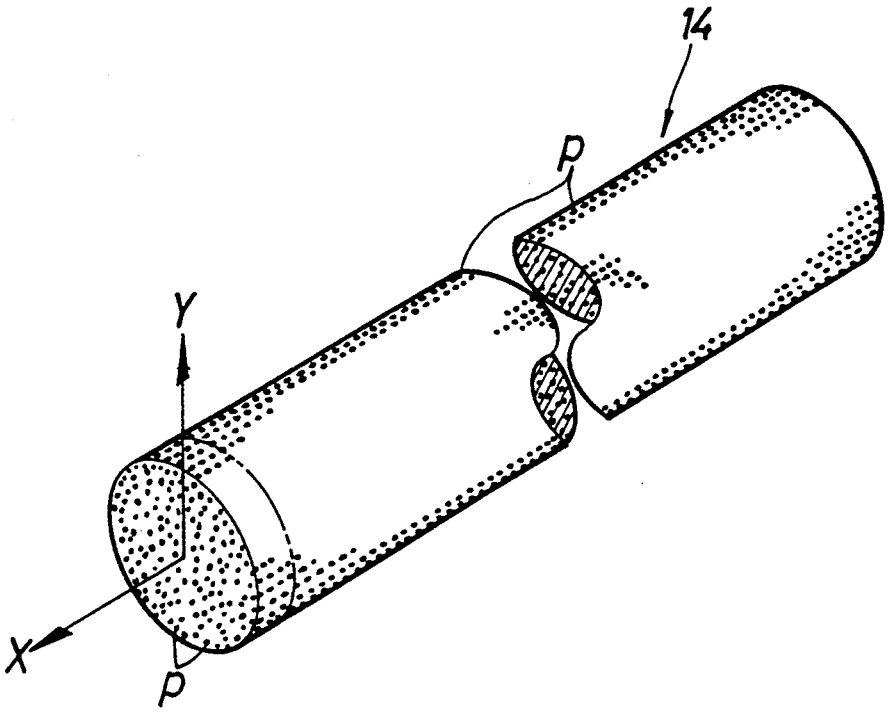
FIG. 2 is a perspective view of a wear resistant aluminum alloy formed by a hot extrusion.

As shown in FIG. 2, the flow pattern of a fiber structure of the material in the aluminum alloys $a_1$ to $a_3$, $b_1$ and $b_2$, and thus the bar-like products 14 is parallel to an extruding direction X, and if the area rate in the extruding direction X is represented by A, and the area rate in a direction Y perpendicular to the extruding direction X is by B, the ratio of the both, i.e., A/B is the ratio of the area rates.

In this case, particles of the hard grain mixture p are arranged along the flow pattern of the fiber structure of the material and thus in the extruding direction X.

Then, the bar-like product 14 was cut into two types of first and second test pieces which were then subjected to a slide wear test to provide the results given in Table II.

Figure 3A:
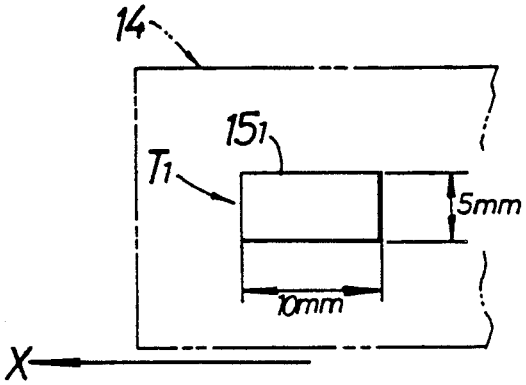
FIG. 3A is a diagram for explaining how the aluminum alloy is cut into a first test piece.
Figure 3B:
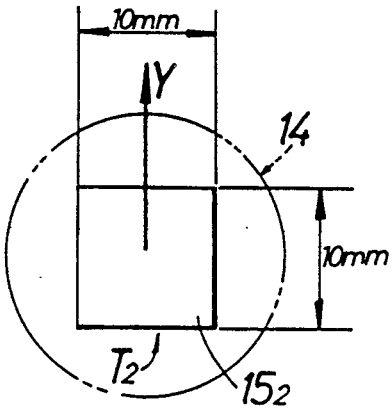
FIG. 3B is a diagram for explaining how the aluminum alloy is cut into a second test piece.

The size of each test piece is 10 mm long×10 mm wide×5 mm thick. As shown in FIG. 3A, the first test piece T1 was cut so that a square slide surface $15_1$ thereof may be parallel to the extruding direction X. On the other hand, as shown in FIG. 3B, the second test piece T2 was cut so that a square slide surface $15_2$ thereof may be parallel to the direction Y perpendicular to the extruding direction.

The slide wear test was conducted over a sliding distance of 18 km by pressing the slide surface $15_1$, $15_2$ of each of the first and second test pieces $T_1$ and $T_2$, with a pressure of 200 kg/cm$^2$, onto a disc of a silicon-chromium steel (JIS SWOSC-carburized material) with a diameter of 135 mm which is rotatable at a rate of 2.5 m/sec., while dropping a lubricating oil under a condition of 5 cc/min. The amount of wear was measured by determining a difference (μm) in thickness for the first and second test pieces T1 and T2 before and after the test. It is to be noted that the silicon-chromium steel is used as a material for forming the valve spring.

TABLE II

| | Amount of Wear (μm) | |
|---|---|---|
| Aluminum alloy | First test piece $T_1$ | Second test piece $T_2$ |
| $a_1$ | 0.5 | 0.8 |
| $a_2$ | 0.4 | 0.7 |
| $a_3$ | 0.2 | 0.4 |
| $b_1$ | 12.0 | 12.2 |
| $b_2$ | 5.0 | 5.4 |

It is apparent from Table II that for the aluminum alloys $a_1$ to $a_3$, because the particles of the hard grain mixture are arranged along the flow pattern of the material in the slide surface $15_1$ of the first test piece T1, the area rate of the hard grain mixture on that slide surface $15_1$ is higher than that on the slide surface $15_2$ of the second test piece T2. Therefore, the wear resistance of the slide surface $15_1$ of the first test piece T1 is improved as compared with the slide surface $15_2$ of the second test piece $15_2$.

For the alloys $b_1$ and $b_2$ of Comparative Examples because the area rates of the hard grain mixture are lower on the slide surfaces $15_1$ and $15_2$ of the first and second test pieces T1 and T2, the amount of wear of the test pieces are larger. In addition, because the ratios of the area rates thereof are smaller, there is little difference in worn amount between both the slide surfaces $15_1$ and $15_2$.

Figure 4B:
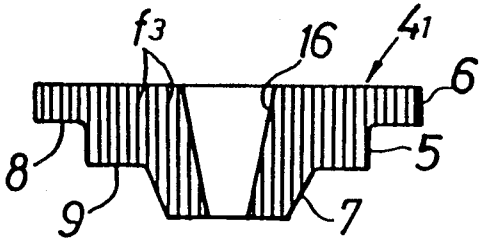
FIG. 4B is a diagram illustrating a flow pattern of a fiber structure of a material in a valve spring retainer of a comparative example.
Figure 4A:
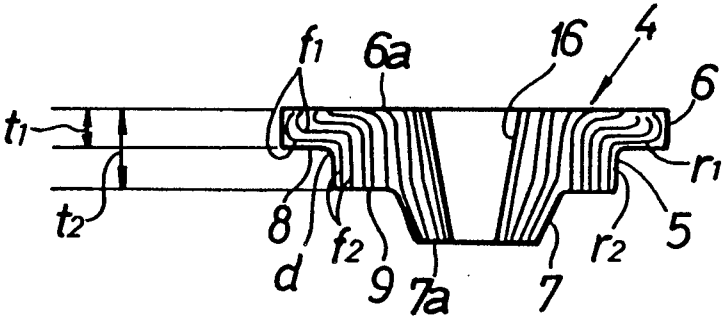
FIG. 4A is a diagram illustrating a flow pattern of a fiber structure of a material in a valve spring retainer according to the present invention.
Figure 7:
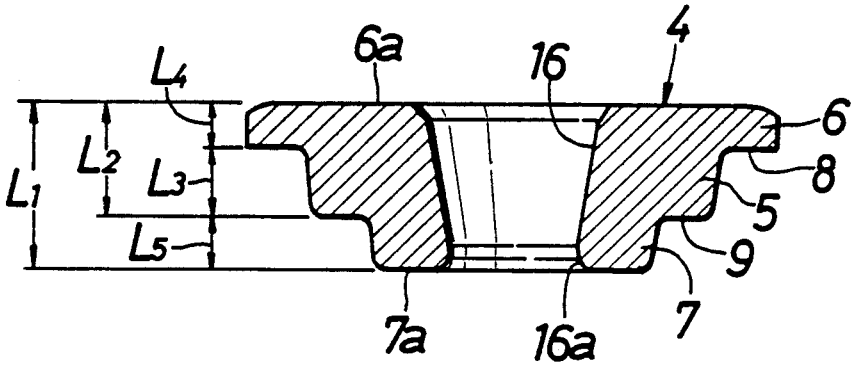
FIG. 7 is a sectional view of the valve spring retainer.

On the basis of the results of the slide wear test, a flow pattern $f_1$ of the fiber structure of the material in a surface layer region r1 having the outer seat surface 8 in the valve spring retainer 4 according to the present invention, is clearly shown in FIG. 4A. In addition, the flow pattern $f_1$ in the surface layer region $r_1$ is continuous with a flow pattern $f_2$ of the fiber structure along an axis of the material in a surface region $r_2$ of the base portion 5. Therefore, the inner seat surface 9 is formed into a surface perpendicular to the flow pattern $f_2$. In FIGS. 4(A), 4(B) and 7, the reference numeral 16 is a mounting hole for the valve stem passing through the flange portion 6, the base portion 5 and the projection 7. An inner peripheral surface of the mounting hole 16 is formed into a tapered surface convergent toward the outer end face 7*a* of the projection 7 from the outer end face 6*a* of the flange portion 6.

A valve spring retainer 4 as described above may be produced through the following steps.

Figure 5A:
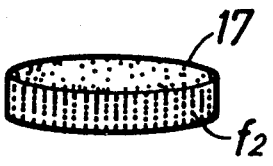
FIGS. 5A to 5E are diagrams for explaining steps of producing the valve spring retainer by forging.

The bar-like product 14 shown in FIG. 2 is sliced as shown by a dashed line to provide a disk-like billet 17 having a thickness of 7 mm as shown in FIG. 5A. Thus, a flow pattern of the fiber structure along the axis of the material as with the flow pattern $f_2$ exists in this billet 7.

Figure 5B:
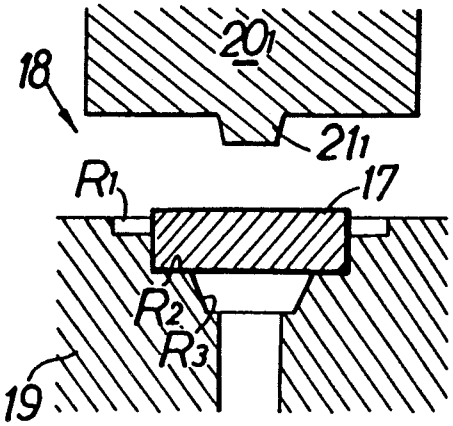

As shown in FIG. 5B, the billet 17 is placed onto a base portion shaping region R2 of a lower die 19 in a closed forging apparatus 18. The reference character $20_1$ is a first upper die having a tapered pressing projection $21_1$.

Figure 5C:
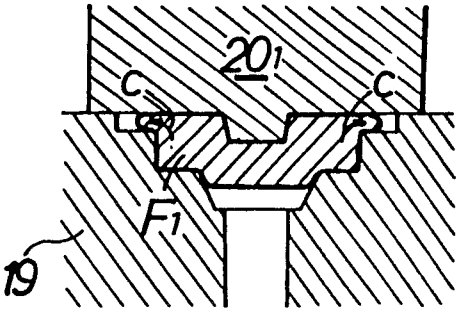

As shown in FIG. 5C, the billet 17 is pressed by the first upper die 20, so that a lower side of the billet 17 is expanded into a projection shaping region R3 of the lower die 19 and at the same time, an upper side of the billet 17 is widened into a flange shaping region R1 to provide a primary formed product F1. This widening action causes the material to flow radially as indicated by an arrow c, thereby providing a flow pattern $f_1$ as described above.

Figure 5D:
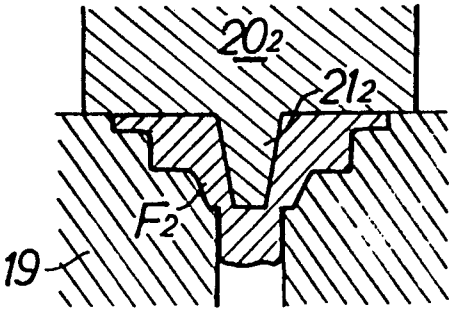

As shown in FIG. 5D, the primary formed product F1 is pressed by a second upper die $20_2$ having a tapered pressing projection $21_2$ longer than the pressing projection $21_1$ of the first upper die $20_1$, so that a lower portion of the primary formed product F1 is filled into the projection shaping region R3 to provide a projection 7. In addition, an upper portion of the primary formed product F1 is filled into the flange shaping region R1 to provide a flange portion 6. Further, a mounting hole 16 is shaped by the pressing projection $21_2$, thus providing a secondary formed product F2. Even at this flange portion 6 shaping step, a similar widening action is performed.

Figure 5E:
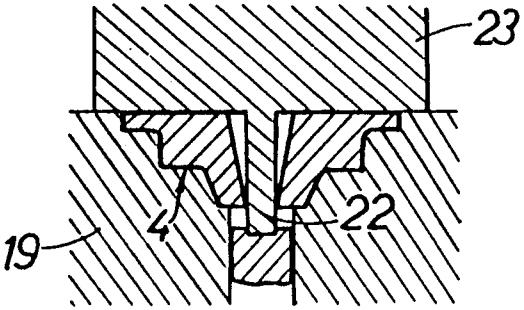

As shown in FIG. 5E, the secondary formed product F2 is punched by a punch 23 having a punching projection 22 longer than the pressing projection $21_2$ of the second upper die $20_2$, so that the mounting hole 16 is penetrated, thereby providing a valve spring retainer 4.

Table III illustrates results of a actual durability test conducted for 100 hours for the valve spring retainers made in the same technique as described above using the aforesaid aluminum alloys $a_1$ to $a_3$, $b_1$ and $b_2$. In Table III, the valve spring retainers $a_1$ to $a_3$, $b_1$ and $b_2$ were made from the aluminum alloys $a_1$ to $a_3$, $b_1$ and $b_2$, respectively. Hence, the valve spring retainers $a_1$ to $a_3$ correspond to the present invention, and the valve spring retainers $b_1$ and $b_2$ correspond to Comparative Examples. In the above test, the ratio of slide surface pressures on the outer and inner seat surfaces 8 and 9 by the load distribution between the outer and inner valve springs 10 and 11 was set such that outer seat surface 8 ratio to inner seat surface 9=1.8:1.

The amount of wear was measured by determining a difference (μm) between the thicknesses $t_1$ and $t_2$ of the outer and inner seat surfaces 8 and 9 before and after the test (FIG. 4A).

TABLE III

| | amount of wear (μm) | |
|---|---|---|
| Valve spring retainer | Outer seat surface | Inner seat surface |
| Present invention | | |
| $a_1$ | 28 | 25 |
| $a_2$ | 20 | 19 |
| $a_3$ | 10 | 11 |
| Comparative Example | | |
| $b_1$ | 450 | 120 |
| $b_2$ | 300 | 95 |

It can be seen from Table III that in the valve spring retainers $a_1$ to $a_3$ according to the present invention, the difference in amount of wear between the outer and inner seat surfaces 8 and 9 is slight and consequently, it is possible to suppress the variation in load distribution of the outer and inner valve springs 10 and 11 to the utmost. This is attributable to the fact that the flow pattern $f_1$ of the fiber structure of the material in the surface layer region $r_1$ having the outer seat surface 8 has been formed as described above to improve the outer seat surface 8 and to the fact that the above-described ratios of the area rates possessed by the aforesaid aluminum alloys $a_1$ to $a_3$ have been substantially established.

Figure 6:
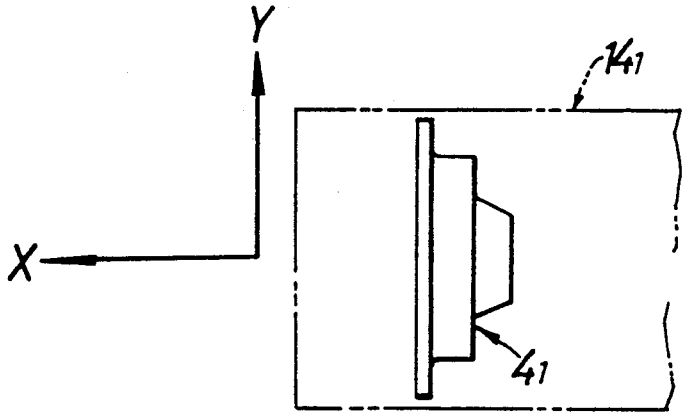
FIG. 6 is a view for explaining a cutting process for the valve spring retainer of the comparative example.

For the purpose of conducting a fatigue test, a barlike product $14_1$ having a diameter of 35 mm and as shown in FIG. 6 was produced as a comparative example in the same manner as described above, and subjected to cutting operations to fabricate a valve retainer $4_1$ with its axis aligned with the extruding direction X. In this valve spring retainer $4_1$, a flow pattern $f_3$ of the fiber structure of the material is all in an axial direction as shown in FIG. 4B.

For the valve spring retainer 4 according to the present invention, the aforesaid present invention $a_2$ was used.

The area rates and the ratio a/b of the area rates of the hard grain mixture on the outer and inner seat surfaces 8 and 9 of the present invention $a_2$ and the comparative example are as given in Table IV. Here, in the ratio a/b of the area rates, a corresponds to the area rate on the outer seat surface 8, and b corresponds to the area rate on the inner seat surface.

TABLE IV

| | Present invention $a_2$ | | Comparative example | |
|---|---|---|---|---|
| | OSS | ISS | OSS | ISS |
| Area rate (%) | 3.6 | 2.4 | 3.02 | 2.99 |
| Ratio of area rates (a/b) | 1.5 | | 1.0 | |

OSS = Outer seat surface
ISS = Inner seat surface

Each of the valve spring retainers 4 and $4_1$ was secured to the valve stem 3 of the intake valve 2, and a tensile-tensile fatigue test was conducted with one of jigs engaged with the valve face 2a and the other jig engaged with the outer seat surface 8 to determine the fatigue strength of the junction d (FIG. 4A) between the flange portion 6 and the projection 7 in each of the valve spring retainers 4 and $4_1$, thereby providing results given in Table V.

The fatigue strength is represented by a load at a repeated-loading number of $10^7$ to the fracture and at a fracture probability of 10%.

TABLE V

| | Fatigue strength (kg) |
|---|---|
| Present invention $a_2$ | 600 |
| Comparative example | 480 |

As can be seen from Table V, the present invention $a_2$ is improved in fatigue strength, as compared with the comparative example. This is attributable to the fact that the flow patterns $f_1$ and $f_2$ of the fiber structure of the material are continuous as described above.

The ratio a/b of the area rate a of the hard grain particles of the outer seat surface to the area rate b of the hard grain particles on the inner seat surface may be set such that $1.05 \leqq a/b \leqq 1.50$.

By increasing the area rate of the hard grain particles on the outer seat surface in this way and by setting such area rate and the area rate of the hard grain particles on the inner seat surface into a particular relationship, it is possible to moderate the difference in amount of wear between the outer and inner seat surfaces as described above. If the ratio $a/b < 1.05$, the resulting valve spring retainer will have no difference in amount of wear between the outer and inner seat surfaces and hence, cannot serve a practical use. On the other hand, if a/b > 1.50, the resulting valve spring retainer will have a lower strength and likewise cannot serve a practical use.

FIG. 7 illustrates another embodiment of a valve spring retainer made in a manner similar to that described above. In this valve spring retainer 4, when the axial length is L1 between the outer end face 6a of the flange portion 6 and the outer end face 7a of the projection 7, and the axial length is L2 between the outer end face 6a of the flange portion 6 and the inner seat surface 9, L2 > ½ L1. In addition, when axial length is L3 between the outer seat surface 8 and the inner seat surface 9; the axial length is L4 between the outer end face 6a of the flange portion 6 and the outer seat surface 8, and the axial length is L5 between the outer end face 7a of the projection 7 and the inner seat surface 9, L3 > L4, and L3 > L5.

In the present embodiment, L1 = 8.8 mm; L2 = 6.0 mm; L3 = 3.8 mm; L4 = 2.2 mm; and L5 = 2.8 mm. The outside diameter of the outer end face 6a of the flange 6 and thus the outer seat surface 8 is of 28.0 mm; the outside diameter of the outer end face 7a of the projection 7 is of 15.4 mm; and the outside diameter of the inner seat surface 9 is of 21.7 mm.

With such a construction, the wall thickness of the base portion 5 is increased and hence, it is possible to improve the rigidity of the entire valve spring retainer 4.

The outer peripheral surfaces of both the base portion 5 and the projection 7 are formed into tapered surfaces convergent toward the outer end face 7a of the projection 7, wherein the tapered angle is set at 5° in each case.

If the valve spring retainer is constucted in such a manner, not only the continuity of the internal crystal is improved as compared with a construction in which the both outer peripheral surfaces are perpendicular to the outer and inner seat surfaces 8 and 9, but also the spraying of a lubricating oil flying from the shaft end side of the valve stem 3, is facilitated, and there is also an effect of suppressing the thermal deformation of the valve spring retainer 4. Further, it is possible to prevent the individual valve springs 10 and 11 from abutting against the outer peripheral surfaces.

In a mounting hole 16 for the valve stem, a rounded portion 16a is provided around the periphery of an edge of an opening located in the outer end face of the projection. The rounded portion 16a is formed by machining and preferably has a curvature radius of 1.5 mm.

If the valve spring retainer is constructed in this manner, a flash will not remain at the opening edge, and it is also possible to avoid the concentration of stress. In order to obtain this effect, the curvature radius may be as small as 0.5 mm.

A second example of a material for the valve spring retainer will be described below.

For a quenched and solidified aluminum alloy powder for forming a matrix, a powder was produced utilizing an atomizing process, which consists of 14.5% by weight of Si, 2.5% by weight of Cu, 0.6% by weight of Mg, 4.6% by weight of Fe, 2.1% by weight of Mn, and the balance of Al including unavoidable impurities.

Grains similar to those previously described were prepared as hard grains, and a hard grain mixture was produced by selecting the following grains from these prepared grains.

| | |
|---|---|
| $Al_2O_3$ grain | 48.5% by weight |
| $ZrO_2$ grain | 30.2% by weight |
| $SiO_2$ grain | 20.0% by weight |
| $TiO_2$ grain | 1.3% by weight |

Aluminum alloys $a_4$ and $a_5$ having area rates of the hard grain mixture given in Table VI were produced by blending the hard grain mixture in added amounts given in Table VI to the aluminum alloy powder and through individual steps which will be described hereinbelow.

The aluminum alloy powder and the hard grain mixture were blended in a V-shaped blender, and the individual blended powders were then subjected to a cold isostatic pressing process (CIP process) to provide powder compacts. Then, the individual powder compacts were placed into a uniform heat oven and left therein for a predetermined time. Thereafter, they were subjected to a hot extrusion to provide the aluminum alloys $a_4$ and $a_5$ each formed into a rounded bar and having a diameter of 35 mm and a length of 800 mm.

TABLE VI

| Alluminum alloy | Hard grain mixture | |
|---|---|---|
| | Added amount (% by weight) | Area rate (%) |
| $a_4$ | 0.7 | 1.0 |
| $a_5$ | 3.0 | 4.5 |

For comparison, comparative alloys $b_3$ and $b_4$ having area rates of hard grain mixture given in Table VII were produced by blending the hard grain mixture in added amounts in Table VII to an aluminum alloy of the same composition as described above and through the same steps as the above-described steps.

TABLE VII

| Comparative alloy | Hard grain mixture | |
|---|---|---|
| | Added amount (% by weight) | Area rate (%) |
| $b_3$ | 0.07 | 0.1 |
| $b_4$ | 6.7 | 10.0 |

The aluminum alloys $a_4$ and $a_5$ and the comparative alloys $b_3$ and $b_4$ were cut into test pieces which were then subjected to a slide wear test to provide results given in Table VIII.

The slide wear test was conducted over a sliding distance of 18 km by pressing the test pieces 10 mm long × 10 mm wide × 5 mm thick with a pressure of 200 kg/cm$^2$ onto a disc of a chromium-vanadium steel (JIS SWOCV) with a diameter of 135 mm which is rotatable at a rate of 2.5 m/sec., while dropping a lubricating oil under a condition of 5 cc/min. The amount of wear was measured by determining a difference (g) in weight for the test pieces and the disc before and after the test. It is to be noted that the chromium-vanadium steel is used as a material for forming the valve spring.

TABLE VIII

| | Worn amount (g) |
|---|---|
| Aluminum alloy | |
| $a_4$ | 0.0009 |
| $a_5$ | 0.0004 |
| Comparative Example | |
| $b_3$ | 0.01 |
| $b_4$ | 0.0001 |

It is apparent from Table VIII that each of the aluminum alloys $a_4$ and $a_5$ has an excellent wear resistance. In addition, it was confirmed hat the amount of disc wear was suppressed to 0.0002 g in a combination with the aluminum alloy $a_4$ and to 0.0003 g in a combination with the aluminum alloy $a_5$. This makes it clear that the aluminum alloys $a_4$ and $a_5$ exhibit an excellent slide characteristic in a combination with the valve spring. On the other hand, the alloy $b_3$ of the Comparative Examples was increased in amount of wear because of a smaller added amount of the hard grain mixture and a lower area rate. The Comparative Example alloy $b_4$ a good wear resistance because of a larger added amount and a higher area rate, but the mating disc wear was increased and the amount of disc wear was 0.0007 g.

As described above, the aluminum alloys $a_4$ and $a_5$ exhibit an excellent slide characteristic in a combination with a steel, but in this case, it is desirable that the hardness of the steel is Hv 400 or more. If the hardness of the steel is less than Hv 400, the amount of steel wear will be increased.

A stress corrosion and cracking test (JIS H8711) was carried out for the individual test pieces to provide results given in Table IX.

The stress corrosion and cracking test was conducted by immersing each of test pieces 100 mm long×20 wide×3 mm thick with a loaded stress thereon of $\sigma_{0.2}\times 0.9$ ($\sigma_{0.2}$ being a 0.2% load-carrying capacity of each alloy) into an aqueous solution of NaCl having a concentration of 3.5% and a liquid temperature of 30° C. for 28 days. The superiority or inferiority of the resistance to stress corrosion and cracking was judged by the presence or absence of cracks generated in the test piece.

TABLE IX

| | Presence or absence of cracks |
|---|---|
| Aluminum alloy | |
| $a_4$ | absence |
| $a_5$ | absence |
| Alloy of Comparative Example | |
| $b_3$ | absence |
| $b_4$ | presence |

As apparent from Table IX, the aluminum alloys $a_4$ and $a_5$ and the alloy $b_3$ of the Comparative Examples each have an excellent resistance to stress corrosion and cracking. The alloy $b_4$ of the Comparative Examples has a deteriorated resistance to stress corrosion and cracking, because of a higher area rate of the hard grain mixture thereof.

Further, a compression-tensile fatigue test was repeated $10^7$ runs for every test piece at a temperature of 150° C. to provide results given in FIG. X.

TABLE X

| | Fatigue limit (kg/mm$^2$) |
|---|---|
| Aluminum alloy | |
| $a_4$ | 17.2 |
| $a_5$ | 17.0 |
| Alloy of Comparative Example | |
| $b_3$ | 16.8 |
| $b_4$ | 12.1 |

It can be seen from Table X that the aluminum alloys $a_4$ and $a_5$ and the alloy $b_3$ of Comparative Examples each have a relatively large fatigue strength. The alloy $b_4$ of the Comparative Examples has a smaller fatigue strength, because of a higher area rate of the hard grain mixture thereof.

It is apparent from the aforesaid individual tests that the aluminum alloys $a_4$ and $a_5$ are excellent in resistances to wear and to stress corrosion and cracking and each has a relatively large fatigue strength.

Therefore, the aluminum alloys $a_4$ and $a_5$ are most suitable for use as a material for forming a machanical structural member used at a high temperature under a high surface pressure and under a rapid sliding movement, e.g., a slide member for an internal combustion engine, and particularly, a material for forming a spring retainer used in a valve operating system.

Figure 8:
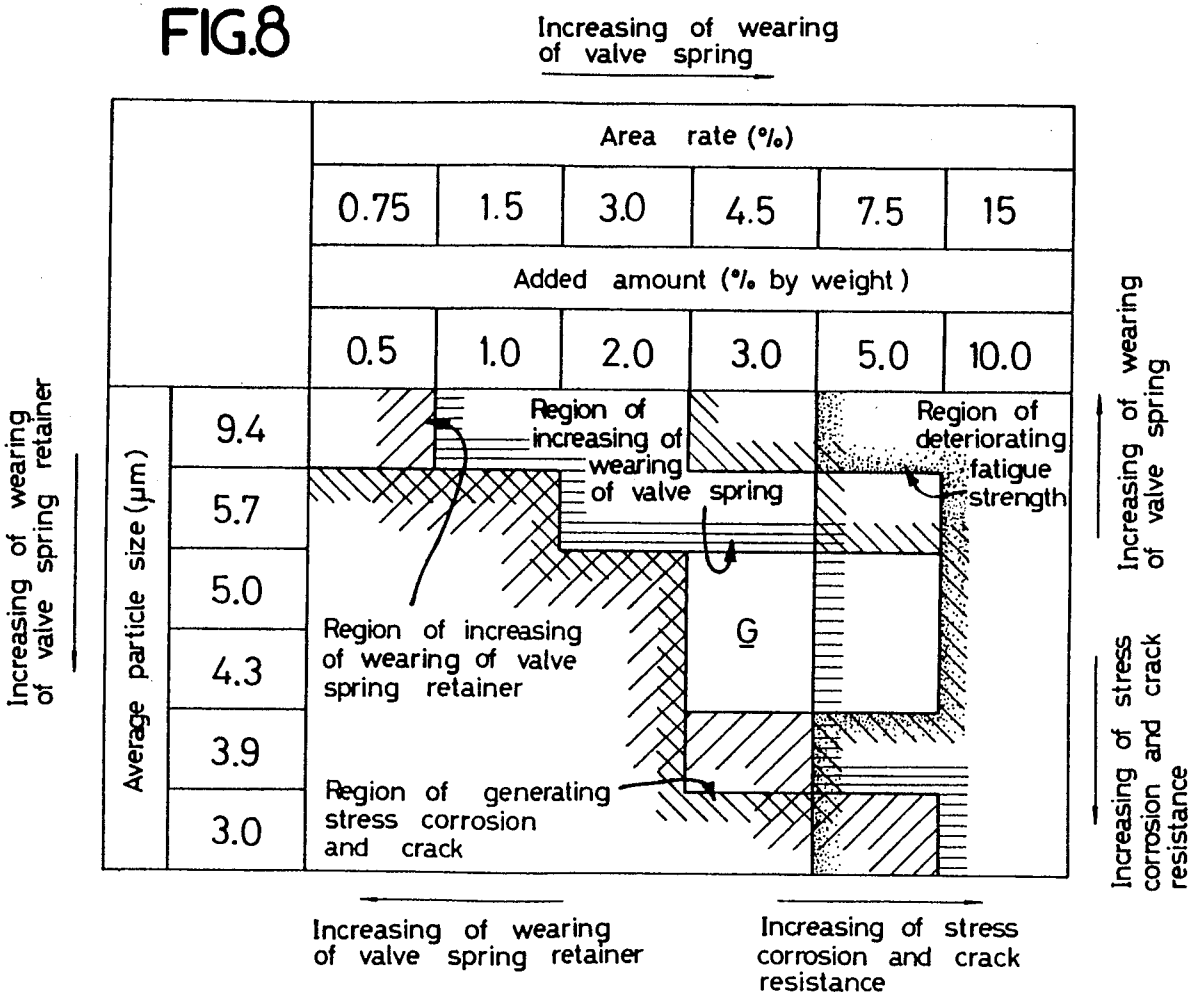
FIG. 8 is a graph illustrating a relationship between the amount of hard grains added and the like, and the properties of the valve spring retainer and the valve spring.

FIG. 8 illustrates a relationship among the added amount and area rate of the hard grains, the average grain size of the hard grains, and the natures of a valve spring retainer and a valve spring, when the valve spring retainer is formed of the aluminum alloy. In a combination of the valve spring retainer and the valve spring, an optimal range is a region indicated by G in FIG. 8.

A third example of a material for the valve spring retainer will be described below.

An aluminum alloy for this material is comprised of a matrix formed of a quenched and solidified aluminum alloy powder, and hard grains dispersed in the matrix. The hard grains used are similar to those described above. The average grain size of the hard grains is set such that $3\ \mu m \leqq D \leqq 30\ \mu m$, and the added amount L is set such that 0.5% by weight $\leqq L \leqq$ 20% by weight.

Further, the hardness Hv of the hard grains is set such that $700 \leqq Hv \leqq 3{,}000$, and when $K=(L+0.5)(D-1)$ in this range of the hardness, $200<K\leqq 600$ when $700\leqq Hv<1{,}000$; $80<K\leqq 200$, when $1{,}000\leqq Hv<1{,}500$; $35<K\leqq 80$ when $1{,}500\leqq Hv<2{,}000$; and $13\leqq K\leqq 35$ when $2{,}000\leqq Hv\leqq 3{,}000$.

In this case, if the average grain size D of the hard grains is smaller than 3 μm, the wear resistance of the matrix is lower. On the other hand, if $D>30\ \mu m$, the fatigue strength of the matrix will be reduced, and the wearing of the valve spring will be increased, resulting in a valve spring retainer that cannot be put into practical use.

Further, if the added amount L of the hard grains is smaller than 0.5% by weight, the wear resistance of the matrix also will not be improved. On the other hand, if $L>20\%$ by weight, the fatigue strength of the matrix also will be reduced, and the wearing of the valve spring will be increased, resulting in a valve spring retainer that cannot be put into practical use.

Yet further, if the hardness Hv of the hard grains is smaller than 700 or if $Hv>3{,}000$, the intended slide characteristics cannot be obtained.

In this case, in $700\leqq Hv<1{,}000$, the wearing of the matrix will be increased when $K\leqq 200$, on the one hand, and the wearing of the valve spring will be increased when $K>600$, on the other hand.

In $1{,}000\leqq Hv<1{,}500$, the wearing of the matrix also will be increased when $K\leqq 80$, on the one hand, and the wearing of the valve spring also will be increased when $K>200$, on the other hand.

Further, in $1{,}500\leqq Hv<2{,}000$, the wearing of the matrix also will be increased when $K<35$, on the one hand, and the wearing of the valve spring also will be increased when $K>80$, on the other hand.

Yet Further, in $2{,}000\leqq Hv\leqq 3{,}000$, the wearing of the matrix also will be increased when $K<13$, on the one hand, and the wearing of the valve spring also will be increased when $K>35$, on the other hand.

Figure 9:
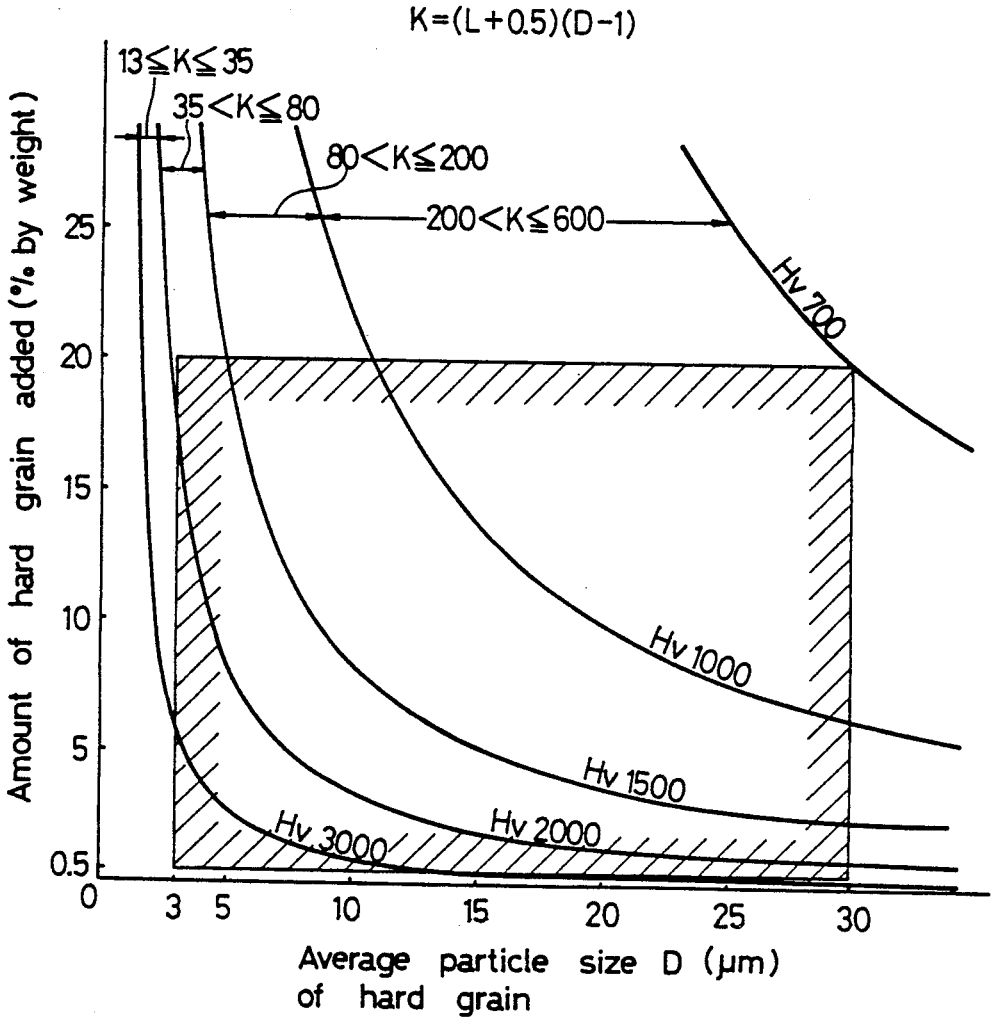
FIG. 9 is a graph illustrating a relationship between the average particle size of the hard grain and the amount of hard grain added in a hardness Hv of 700 to 3,000 of the hard grain.

FIG. 9 illustrates a relationship between the average grain size and the added amount of the hard grains in the aforesaid range of the hardness Hv of the hard grains. In FIG. 9, a range surrounded by oblique lines is for the material used in the present invention.

Specified examples will be described below.

For a quenched and solidified aluminum alloy powder, a powder consisting of 14.5% by weight of Si, 2.5% by weight of Cu, 0.5% by weight of Mg, 4.5% by weight of Fe, 2.0% by weight of Mn, and the balance of Al including unavoidable impurities was produced utilizing an atomizing process.

Aluminum alloys $a_6$ to $a_{15}$ were produced by blending hard grains having various average grain sizes in added amounts given in Table XI to the aluminum alloy powder according to FIG. 9 and through steps which will be described below.

The aluminum allow powder and the hard grains were blended in a V-shaped blender and then, the resulting powder mixture was subjected to a cold isostatic pressing process (CIP process) to provide a powder compact which was then placed into a uniform heat oven and left therein for a predetermined time. Thereafter, the powder compact was subjected to a hot extrusion, thus providing the aluminum alloys $a_6$ to $a_{15}$ formed into a rounded bar having a diameter of 35 mm and a length of 400 mm.

TABLE XI

| Aluminum alloy | Hard grains: $Al_2O_3$ Hv 2,500 AGS (μm) | $Al_2O_3$ Hv 2,500 AA (%) | $Al_2O_3$ $SiO_2$ Hv 1,100 AGS (μm) | $Al_2O_3$ $SiO_2$ Hv 1,100 AA (%) | Metal Si Hv 800 AGS (μm) | Metal Si Hv 800 AA (%) | K |
|---|---|---|---|---|---|---|---|
| $a_6$ | 3 | 15 | — | — | — | — | 31 |
| $a_7$ | 5 | 4 | — | — | — | — | 18 |
| $a_8$ | 7 | 2 | — | — | — | — | 15 |
| $a_9$ | 15 | 0.5 | — | — | — | — | 14 |
| $a_{10}$ | 30 | 0.5 | — | — | — | — | 29 |
| $a_{11}$ | — | — | 10 | 15 | — | — | 139.5 |
| $a_{12}$ | — | — | 20 | 7 | — | — | 142.5 |
| $a_{13}$ | — | — | 30 | 6 | — | — | 188.5 |
| $a_{14}$ | — | — | — | — | 22 | 20 | 430.5 |
| $a_{15}$ | — | — | — | — | 29 | 16 | 462 |

AGS = Average grain size
AA (%) = Added amount (% by weight)

For comparison, alloys $b_5$ to $b_{11}$ of Comparative Examples were produced by blending hard grains having various average grain sizes in added amounts given in Table XII to an aluminum alloy of the same composition as described above and through the same steps as descrived above. The alloy $b_{12}$ of the Comparative Examples containes no hard grains and comprises only the aluminum alloy matrix.

TABLE XII

| Comparative alloy | Hard grains: $Al_2O_3$ Hv 2,500 AGS (μm) | $Al_2O_3$ Hv 2,500 AA (%) | $Al_2O_3$ $SiO_2$ Hv 1,100 AGS (μm) | $Al_2O_3$ $SiO_2$ Hv 1,100 AA (%) | Metal Si Hv 800 AGS (μm) | Metal Si Hv 800 AA (%) | K |
|---|---|---|---|---|---|---|---|
| $b_5$ | 2.5 | 0.2 | — | — | — | — | 1.05 |
| $b_6$ | 20 | 20 | — | — | — | — | 430.5 |
| $b_7$ | 50 | 25 | — | — | — | — | 1249.5 |
| $b_8$ | — | — | 3 | 1 | — | — | 3 |
| $b_9$ | — | — | 40 | 25 | — | — | 994.5 |
| $b_{10}$ | — | — | — | — | 5 | 1 | 6 |
| $b_{11}$ | — | — | — | — | 60 | 25 | 1504.5 |
| $b_{12}$ | — | — | — | — | — | — | — |

AGS = Average grain size
AA (%) = Added amount (% by weight)

The aluminum alloys $a_6$ to $a_{15}$ and the comparative alloys $b_5$ to $b_{12}$ were cut into test pieces which were then subjected to a slide wear test to provide results given in Tables XIII and XIV.

The slide wear test was conducted over a slide distance of 18 km by pressing the test piece 10 mm long × 10 mm wide × 5 mm thick with a pressure of 200 kg/cm$^2$ onto a disc of a silicon-chromium steel (JIS SWOSC-carburized material) with a diameter of 135 mm which is rotatable at a rate of 2.5 m/sec., while dropping a lubricating oil under a condition of 5 cc/min. The amount of wear was measured by determining a difference (μm) in thickness for the test piece and the disc before and after the test.

TABLE XIII

| Aluminum alloy | Amount of Wear: Test piece | Amount of Wear: Disc |
|---|---|---|
| $a_6$ | 0.5 | 0.5 |
| $a_7$ | 0.4 | 0.4 |
| $a_8$ | 0.5 | 0.5 |
| $a_9$ | 0.5 | 0.6 |
| $a_{10}$ | 0.6 | 0.6 |
| $a_{11}$ | 0.5 | 0.5 |
| $a_{12}$ | 0.5 | 0.4 |
| $a_{13}$ | 0.4 | 0.4 |
| $a_{14}$ | 0.5 | 0.5 |
| $a_{15}$ | 0.5 | 0.5 |

TABLE XIV

| Comparative alloy | Amount of Wear: Test piece | Amount of Wear: Disc |
|---|---|---|
| $b_5$ | 12 | ≦0.1 |
| $b_6$ | ≦0.1 | 15.0 |
| $b_7$ | ≦0.1 | 55 |
| $b_8$ | 20 | ≦0.1 |
| $b_9$ | 0.2 | 11.0 |
| $b_{10}$ | 40 | ≦0.1 |
| $b_{11}$ | 0.2 | 4.5 |

TABLE XIV-continued

| Comparative alloy | Amount of Wear | |
|---|---|---|
| | Test piece | Disc |
| $b_{12}$ | 2,500 | ≦0.1 |

As apparent from Tables XIII and XIV, the aluminum alloys $a_6$ to $a_{15}$ are smaller in amount of wear as compared with the comparative alloys $b_5$ to $b_{12}$ and exhibit an excellent slide characteristic for suppressing the wearing of the disc which is a mating steel member. This is attributable to the fact that the hardness, the grain size and the added amount of the hard grains dispersed in the matrix was set to proper values as described above.

Using the aluminum alloys $a_6$, $a_8$, $a_{10}$, $a_{12}$, $a_{14}$ and $a_{15}$ and the comparative alloys $b_5$, $b_7$, $b_8$, $b_{10}$ and $b_{12}$, valve spring retainers were produced in a manner similar to that described above and subjected to an actual durability test to determine the amounts of wear of the valve spring retainers 4 and outer valve springs 10, thereby providing results given in Tables XV and XVI.

The amount of wear was measured by determining the difference (μm) in thickness of the flange portions of the valve spring retainers and the ends of the outer valve spring before and after the test. The outer valve spring is formed of a silicon-chromium (JIS SWOSC-V).

TABLE XV

| Aluminum alloy | Amount of Wear (μm) | |
|---|---|---|
| | Valve spring retainer | Outer valve spring |
| $a_6$ | 20 | 19 |
| $a_8$ | 18 | 18 |
| $a_{10}$ | 21 | 21 |
| $a_{12}$ | 19 | 20 |
| $a_{14}$ | 19 | 19 |
| $a_{15}$ | 21 | 20 |

TABLE XVI

| Comparative alloy | Amount of Wear (μm) | |
|---|---|---|
| | Valve spring retainer | Outer valve spring |
| $b_5$ | 105 | 4 |
| $b_7$ | 2 | 450 |
| $b_8$ | 210 | 12 |
| $a_{10}$ | 370 | ≦1 |
| $a_{12}$ | Flange portion worn | ≦1 |

As apparent from Tables XV and XVI, the valve spring retainers made using the aluminum alloys $a_6$ and $a_8$ are smaller in amount of wear and exhibit an excellent slide characteristic for suppressing the wearing of the outer valve springs. On the contrary, the valve spring retainers made using the comparative alloys $b_5$ and $b_7$ are either too high in wear resistance to cause an increased amount of wear of the outer valve spring, or too low in wear resistance to lead to an increased amount or wear of the valve spring retainers themselves. Consequently, the slide characteristic is degraded.

A fourth example of a material for the valve spring retainer will be described below.

The production of a high strength aluminum alloy as the material was conducted by the preparation of a powder, the formation of a powder compact and the hot forging thereof.

An atomizing process was used for the preparation of the powder. The prepared powder was subjected to a screening treatment, wherein a powder whose particles have a diameter smaller than 100 meshes was collected for use.

At least one hydride-forming component selected from the group consisting of Ti, Zr, Co, Pd and Ni may be added to a molten metal for preparing the powder, or to the prepared powder. To facilitate the formation of a hydride, the latter is preferred.

If necessary, the above-described hard grains may be added to the powder.

The formation of the powder compact includes a primary forming step and a secondary forming step.

The primary forming step is conducted under a forming pressure of 1 to 10 tons/cm$^2$ and at a powder temperature of 300° C. or less, preferably 100° C. to 200° C. In this case, if the powder temperature is lower than 100° C., the density of the powder compact will not be increased. On the other hand, if the powder temperature is higher than 200° C., it is feared that a bridging of the powder may be produced, resulting in a reduced operating efficiency.

The density of the powder compact may be set at 75% or more. Any density lower than this value will result in a degraded handleability.

The secondary forming step is conducted under a forming pressure of 3 to 10 tons/cm$^2$, at a powder compact temperature of 420° C. to 480° C. and at a mold temperature of 300° C. or less, preferably 150° C. to 250° C. In this case, if the mold temperature is lower than 150° C., the density of the powder compact will not be increased. On the other hand, if the mold temperature is higher than 250° C., the lubrication between the mold and the powder compact is difficult, resulting in a fear of seizing of the powder compact.

The density of the powder compact is preferably set in a range of 95% to 100%. If the density is lower than this value, the aluminum alloy will crack in the hot forging step.

It should be noted that in forming the powder compact, only the primary forming step may be used in some cases.

The hot forging may be conducted at a powder compact heating temperature of 350° C. to 500° C. In this case, if the heating temperature is lower than 350° C., the aluminum alloy will crack. On the other hand, it the heating temperature is higher than 500° C., a blister will be produced in the aluminum alloy.

The alumninum alloy is most suitable not only as a material for forming the valve spring retainer, but also as a material for forming other slide members for an internal combustion engine, and may be used, for example, for a cap for bearing members such as a connecting rod, and a bearing cap for a crank journal.

Specified examples will be described below.

TABLE XVII

| | Chemical constituents (% by weight) | | | | | | | | | |
|---|---|---|---|---|---|---|---|---|---|---|
| | Si | Cu | Mg | Fe | Mn | Ti | Zr | Co | Pd | Ni |
| Aluminum Alloy | | | | | | | | | | |
| $a_{16}$ | 18 | 2.2 | 0.7 | 4.2 | 2.1 | 2.0 | — | — | — | — |
| $a_{17}$ | 18 | 2.1 | 0.6 | 4.0 | 1.9 | — | 2.2 | — | — | — |
| $a_{18}$ | 17 | 1.6 | 0.4 | 3.8 | 1.7 | — | — | 1.3 | — | — |
| $a_{19}$ | 16 | 2.5 | 0.5 | 3.9 | 1.8 | — | — | — | 1.5 | — |
| $a_{20}$ | 17 | 1.8 | 0.3 | 4.2 | 1.8 | — | — | — | — | 1.2 |
| $a_{21}$ | 17 | 2.1 | 0.5 | 4.0 | 2.0 | 1.0 | — | — | — | — |
| $a_{22}$ | 18 | 2.0 | 0.6 | 4.0 | 1.8 | 3.6 | — | — | — | — |
| $a_{23}$ | 14.5 | 2.2 | 0.6 | 4.2 | 2.1 | 1.2 | — | — | — | — |
| Comparative example | | | | | | | | | | |
| $b_{13}$ | 17 | 2.5 | 0.5 | 3.9 | 1.8 | — | — | — | — | — |

TABLE XVII-continued

| | Chemical constituents (% by weight) | | | | | | | | | |
|---|---|---|---|---|---|---|---|---|---|---|
| | Si | Cu | Mg | Fe | Mn | Ti | Zr | Co | Pd | Ni |
| $b_{14}$ | 16 | 2.2 | 0.8 | 4.3 | 2.2 | — | — | — | — | — |

Using a molten aluminum alloy containing chemical constituents give in Table XVII, a powder was prepared utilizing an atomizing process and then subjected to a screening to provide a powder having a diameter smaller than 100 meshes of its particles.

The above powder was used to produce a short columnar powder compact having a diameter 60 mm and a height of 40 mm. In this case, the primary forming step was conducted under a forming pressure of 7 tons/cm$^2$ and at a powder temperature of 120° C., and the density of the resulting powder compact was of 80%. The secondary forming step was conducted under a forming pressure of 9 tons/cm$^2$, at a powder compact temperature of 460° C. and at a mold temperature of 240° C., and the density of the resulting powder compact was of 99%.

The powder compacts corresponding to the aluminum alloys $a_{16}$ to $a_{22}$ and the comparative alloy $b_{13}$ were subjected to a hot forging to provide these alloys. The hot forging was conducted under free forging conditions until a powder compact heating temperature of 480° C., a mold temperature of 150° C. and a height of 20 mm were reached.

In addition, the powder compact corresponding to the comparative alloy $b_{14}$ was subjected to a degassing treatment and to a hot extrusion to provide that alloy.

The aluminum alloys $a_{16}$ to $a_{23}$ and the comparative alloys $b_{13}$ and $b_{14}$ were cut into test pieces having a diameter of 5 mm and a length of 20 mm at their parallel portion. Using these test pieces, a compression-tensile fatigue test was repeated $10^7$ runs at a test temperature of 200° C. In addition, for each test piece, a melt gas carrier process was utilized to measure the amount of hydrogen gas.

Table XVIII gives results of the fatigue test and results of the measurement of the amount of hydrogen gas.

TABLE XVIII

| | Fatigue limit (Kg/mm$^2$) | Amount of hydrogen gas (cc/100 g alloy) |
|---|---|---|
| Aluminum alloy | | |
| $a_{16}$ | 14.5 | 8 |
| $a_{17}$ | 14.2 | 10 |
| $a_{18}$ | 14.5 | 11 |
| $a_{19}$ | 14.0 | 9 |
| $a_{20}$ | 14.5 | 10 |
| $a_{21}$ | 14.8 | 11 |
| $a_{22}$ | 14.2 | 12 |
| $a_{23}$ | 14.6 | 11 |
| Comparative alloy | | |
| $b_{13}$ | 9.5 | 12 |
| $b_{14}$ | 15.0 | 2 |

As apparent from Table XVIII, each of the aluminum alloys $a_{16}$ to $a_{23}$ has a relative large fatigue strength in spite of a larger content of hydrogen gas. This is due the fact to that the hydrogen gas in the alloys react with Ti, Zr, Co, Pd or Ni and is thus fixed in the form of a hydride.

The comparative alloy $b_{13}$ has a fatigue strength reduced due to the presence of hydrogen gas, because of the absence of any hydride forming constituents such as Ti and like.

The comparative alloy $b_{14}$ has been provided through the degassing treatment and hence, of course, has a reduced hydrogen gas content and consequently has an improved fatigue strength.

To conduct various tests which will be described hereinbelow, comparative alloys $b_{15}$ and $b_{16}$ having aluminum alloy compositions given in Table XIX were produced. The producing method was the same as for the aluminum alloys $a_{16}$ to $a_{23}$. The composition of the comparative example $b_{15}$ corresponds JIS AC8C which is a forging material.

TABLE XIX

| Comparative alloy | Chemical constituents (% by weight) | | | | |
|---|---|---|---|---|---|
| | Si | Cu | Mg | Fe | Mn |
| $b_{15}$ | 9.2 | 3.2 | 1.0 | <1.0 | <0.5 |
| $b_{16}$ | 20.0 | 3.5 | 1.5 | 5.0 | — |

Table XX gives the thermal expansion coefficient and Young's modulus of the aluminum alloys $a_{16}$ to $a_{23}$ and the comparative alloy $b_{15}$.

TABLE XX

| | Thermal expansion coefficient ($\times 10^{-6}$, 20 to 200° C.) | Young's modulus (200° C., Kg/mm$^2$) |
|---|---|---|
| Aluminum alloy | | |
| $a_{16}$ | 18.0 | 9,200 |
| $a_{17}$ | 18.2 | 9,100 |
| $a_{18}$ | 18.6 | 9,000 |
| $a_{19}$ | 18.4 | 9,300 |
| $a_{20}$ | 18.4 | 9,400 |
| $a_{21}$ | 18.2 | 9,300 |
| $a_{22}$ | 17.8 | 9,500 |
| $a_{23}$ | 18.4 | 9,300 |
| Comparative alloy | | |
| $b_{15}$ | 20.5 | 7,000 |

It can be seen from Table XX that the aluminum alloys $a_{16}$ to $a_{23}$ are reduced in thermal expansion coefficient and improved in Young's modulus as compared with the comparative example $b_{15}$. This is primarily attributable to the content of Fe.

Table XXI gives results of a stress corrosion and crack test (JIS H8711) for the aluminum alloys $a_{16}$ to $a_{23}$ and the comparative alloy $b_{16}$.

The stress corrosion and crack test was conducted by immersing test pieces 10 mm long × 20 mm wide × 3 mm thick with a load stress thereon of $\sigma_{0.2} \times 0.9$ ($\sigma_{0.2}$ being a 0.2% load carrying ability of each alloy) in a 3.5% aqueous solution of NaCl at a liquid temperature of 30° C. for 28 days, and the superiority or inferiority of the stress corrosion and crack resistance was judged by the presence or absence of cracks generated in the test pieces.

TABLE XXI

| | Presence of absence or cracks |
|---|---|
| Aluminum alloy | |
| $a_{16}$ | Absence |
| $a_{17}$ | Absence |
| $a_{18}$ | Absence |
| $a_{19}$ | Absence |
| $a_{20}$ | Absence |
| $a_{21}$ | Absence |
| $a_{22}$ | Absence |
| $a_{23}$ | Absence |
| Comparative alloy | |

TABLE XXI-continued

| | Presence of absence or cracks |
|---|---|
| $b_{16}$ | Presence |

It can be seen from Table XXI that the aluminum alloys $a_{16}$ to $a_{23}$ are excellent in stress corrosion and crack resistance, as compared with the comparative alloy $b_{16}$. This is primarily attributable to the addition of Mn.

Table XXII gives results of a slide wear test for the aluminum alloys $a_{16}$, $a_{17}$ and $a_{18}$ and the comparative alloy $b_{15}$.

The slide wear test was conducted over a sliding distance of 18 km by pressing the test pieces 10 mm long × 10 mm wide × 5 mm thick, with a pressure of 200 kg/cm$^2$, onto a disc of a carbon steel for a mechanical structure (JIS S50C) with a diameter of 135 mm which is rotatable at a rate of 2.5 m/sec., while dropping a lubricating oil under a condition of 5 cc/min. The amount of wear was measured by determining a difference (g) in weight of the test pieces before and after the test.

TABLE XXII

| | Amount of Wear (g) |
|---|---|
| Aluminum alloy | |
| $a_{16}$ | 0.0025 |
| $a_{17}$ | 0.0028 |
| $a_{18}$ | 0.0040 |
| Comparative alloy | |
| $b_{15}$ | 0.06 |

As is apparent from Table XXII, each of the aluminum alloys $a_{16}$, $a_{17}$ and $a_{18}$ has an excellent wear resistance, as compared with the comparative alloy $b_{15}$. This is attributable to the content of Si.

Aluminum alloys $a_{24}$ to $a_{29}$ containing hard grains will be described below.

Chemical constituents of aluminum alloy matrices in the aluminum alloys $a_{24}$ to $a_{29}$ are indentical with the aforesaid aluminum alloys $a_{16}$ to $a_{21}$ given in Table XVII. Various hard grains as given in Table XXIII were dispersed in these matrices. The aluminum alloys $a_{24}$ to $a_{29}$ were produced in the same manner as for the aforesaid aluminum alloys $a_{16}$ to $a_{23}$.

Table XXIII

| Aluminum alloy | Hard grains (% by weight) | | | | | |
|---|---|---|---|---|---|---|
| | $Al_2O_3$ | SiC | $Si_3N_4$ | $ZrO_2$ | Metal Si | $TiO_2$ |
| $a_{24}$ | 3 | — | — | — | — | — |
| $a_{25}$ | — | 2 | — | — | — | — |
| $a_{26}$ | — | — | 3 | — | — | — |
| $a_{27}$ | — | — | — | 2 | — | — |
| $a_{28}$ | — | — | — | — | 4 | — |
| $a_{29}$ | — | — | — | — | — | 3 |

Table XXIV gives results of the fatigue test for the aluminum alloys $a_{24}$ to $a_{29}$ and results of the measurement of the hydrogen content therein. The procedures for the test and the measurement are the same as described above.

TABLE XXIV

| Aluminum alloy | Fatigue limit (Kg/cm$^2$) | Hydrogen gas content (cc/100 g of alloy) |
|---|---|---|
| $a_{24}$ | 15.0 | 8 |
| $a_{25}$ | 15.2 | 10 |
| $a_{26}$ | 15.0 | 11 |

TABLE XXIV-continued

| Aluminum alloy | Fatigue limit (Kg/cm$^2$) | Hydrogen gas content (cc/100 g of alloy) |
|---|---|---|
| $a_{27}$ | 14.5 | 9 |
| $a_{28}$ | 15.0 | 10 |
| $a_{29}$ | 15.2 | 8 |

As apparent from Table XXIV, the aluminum alloys $a_{24}$ to $a_{29}$ are improved in fatigue strength with the addition of the hard grains, as compared with those in Table XVIII.

Table XXV gives the thermal expansion coefficient and Young's modulus of the aluminum alloys $a_{24}$ to $a_{29}$.

TABLE XXV

| Aluminum alloy | Thermal expansion coefficient ($\times 10^{-6}$, 20 to 200° C.) | Young's modulus (200° C., kg/mm$^2$) |
|---|---|---|
| $a_{24}$ | 17.5 | 10,000 |
| $a_{25}$ | 17.8 | 9,700 |
| $a_{26}$ | 18.0 | 10,000 |
| $a_{27}$ | 17.9 | 9,600 |
| $a_{28}$ | 17.8 | 9,800 |
| $a_{29}$ | 17.9 | 9,600 |

As is apparent from Table XXV, the aluminum alloys $a_{24}$ to $a_{29}$ are reduced in thermal expansion coefficient and improved in Young's modulus, as compared with those in Table XX. This is attributable to the fact that the hard grains such as $Al_2O_3$ are dispersed.

The same stress corrosion and crack test (JIS H8711) as described above was conducted for the aluminum alloys $a_{24}$ to $a_{29}$ and as a result, cracking was not observed.

Table XXVI gives results of the slide wear test as described above was conducted for the aluminum alloys $a_{24}$, $a_{25}$ and $a_{26}$.

TABLE XXVI

| Aluminum alloy | Amount of Wear (g) |
|---|---|
| $a_{24}$ | 0.0015 |
| $a_{25}$ | 0.0020 |
| $a_{26}$ | 0.0018 |

As is apparent from Table XXVI, the aluminum alloys $a_{24}$, $a_{25}$ and $a_{26}$ have an excellent wear resistance, as compared with those in Table XXII. This is due to the fact that the hard grains such as $Al_2O_3$ are dispersed.

Table XXVII gives results of a creep test for the aluminum alloys $a_{24}$, $a_{25}$ and $a_{26}$ and the comparative alloy $b_{13}$.

The creep test was conducted by applying a compression force of 12 kg/mm$^2$ to the test pieces having a diameter of 6 mm and a length of 40 mm at their parallel portion at 170° C. for 100 hours. The creep shrinkage amount was measured by determining the rate (%) of the lengthes before and after the test.

TabIe XXVII

| | Creep shrinkage amount (%) |
|---|---|
| Aluminum alloy | |
| $a_{24}$ | 0.03 |
| $a_{25}$ | 0.02 |
| $a_{26}$ | 0.04 |
| Comparative alloy | |
| $b_{13}$ | 0.1 |

As is apparent from Table XXVII, the aluminum alloys $a_{24}$, $a_{25}$ and $a_{26}$ are decreased in creep shrinkage amount, as compared with the comparative alloy $b_{13}$. This is due to the fact that the dislocation of the crystal of the aluminum alloy matrix is fixed by the dispersion of the hard grains such as $Al_2O_3$ in the aluminum alloy matrix.

The creep shrinkage amount of the comparative alloy $b_{14}$ corresponding to a casting material is of 0.04%, and the creep shrinkage amount of each of the aluminum alloys $a_{24}$, $a_{25}$ and $a_{26}$ substantially compare with the casting material.

Table XXVIII gives a relationship between the variation in size of a crank pin hole (a diameter of 55 mm) in a connecting rod and the temperature.

A connecting rod A has its shaft portion formed of a comparative alloy I and has its cap formed of the aluminum alloy $a_{24}$. A connecting rod B has its shaft portion and cap formed of the comparative alloy $b_{13}$. In the connecting rods A and B, the caps are fastened on the side of the shaft portion by a bolt.

TABLE XXVIII

| Connecting rod | Amount of variation in diameter of crank pin hole (μm) | |
|---|---|---|
| | Room temperature | 150° C. |
| A | 0 | +72 |
| B | 0 | +67 |

As is apparent from Table XXVIII, the connecting rod A having the cap formed of the aluminum alloy $a_{24}$ is smaller in amount of variation in diameter of the crank pin hole with an increase of the temperature, as compared with the connecting rod formed of the comparative alloy $b_{13}$. This makes it possible to suppress the variation in clearance between the crank pin and the crank pin hole during operation of the engine. This is attributable to the fact that the reduction of the thermal expansion coefficient has been provided by dispersing 3% by weight of the $Al_2O_3$ grain in the aluminum alloy matrix.

Table XXIX gives chemical constituents of aluminum alloys $a_{30}$ to $a_{43}$, and Table XXX gives results of a fatigue test for these alloys $a_{30}$ to $a_{43}$, as well as results of a measurement of the hydrogen gas amount therein. The methods for the production of these alloys, for the fatigue test and for the measurement of the hydrogen gas amount are the same as for the above-described aluminum alloys $a_{16}$ to $a_{23}$.

TABLE XXIX

| Aluminum alloy | Chemical constituents (% by weight) | | | | | | | | | |
|---|---|---|---|---|---|---|---|---|---|---|
| | Si | Cu | Mg | Fe | Mn | Ti | Zr | Co | Pd | Ni |
| $a_{30}$ | 14 | 1.2 | 1.0 | 4.5 | 1.6 | 1.0 | 1.0 | — | — | — |
| $a_{31}$ | 15 | 2.2 | 0.6 | 3.8 | 1.7 | 1.2 | — | 0.6 | — | — |
| $a_{32}$ | 17 | 2.5 | 0.4 | 3.5 | 2.2 | 1.0 | — | — | 0.4 | — |
| $a_{33}$ | 16 | 2.0 | 0.8 | 4.2 | 1.8 | 1.2 | — | — | — | 1.2 |
| $a_{34}$ | 14 | 2.0 | 0.6 | 4.0 | 1.5 | — | 0.8 | 0.6 | — | — |
| $a_{35}$ | 15 | 1.8 | 0.5 | 3.4 | 2.0 | — | 1.0 | — | 0.8 | — |
| $a_{36}$ | 15 | 1.7 | 0.4 | 4.0 | 1.6 | — | 1.2 | — | — | 0.8 |
| $a_{37}$ | 16 | 2.0 | 0.6 | 3.8 | 1.4 | — | — | 1.5 | 0.3 | — |
| $a_{38}$ | 15 | 1.8 | 0.8 | 3.6 | 1.6 | — | — | 1.4 | — | 0.8 |
| $a_{39}$ | 16 | 2.0 | 0.6 | 4.0 | 0.8 | — | — | — | 0.4 | 2.0 |
| $a_{40}$ | 15 | 2.2 | 0.4 | 3.5 | 1.0 | 0.6 | 0.4 | 0.4 | — | — |
| $a_{41}$ | 15 | 1.8 | 0.4 | 3.3 | 0.8 | 0.4 | 0.6 | — | — | 0.4 |
| $a_{42}$ | 14 | 1.6 | 0.5 | 3.2 | 0.8 | 0.6 | — | 0.3 | — | 0.4 |
| $a_{43}$ | 15 | 1.8 | 0.5 | 3.4 | 0.6 | 0.6 | — | 0.4 | — | 0.4 |

TABLE XXX

| Aluminum alloy | Fatigue limit ($Kg/mm^2$) | Amount of hydrogen gas (cc/100 g alloy) |
|---|---|---|
| $a_{30}$ | 14.0 | 10 |
| $a_{31}$ | 14.2 | 9 |
| $a_{32}$ | 13.2 | 7 |
| $a_{33}$ | 14.6 | 8 |
| $a_{34}$ | 14.0 | 6 |
| $a_{35}$ | 13.2 | 8 |
| $a_{36}$ | 14.6 | 10 |
| $a_{37}$ | 14.2 | 9 |
| $a_{38}$ | 14.2 | 7 |
| $a_{39}$ | 13.6 | 10 |
| $a_{49}$ | 14.8 | 8 |
| $a_{41}$ | 14.0 | 9 |
| $a_{42}$ | 14.6 | 10 |
| $a_{43}$ | 14.8 | 7 |

The above-described spring retainer can be subjected to a thermal treatment to improve the stress corrosion and crack resistance thereof.

For such thermal treatment, the following four methods are applied.

(a) Aging at Room Temperature

The spring retainer is heated at 490° C. for two hours and then cooled with water. Thereafter, the spring retainer is subjected to a natural aging at room temperature for 4 days.

(b) Overaging

The spring retainer is heated at 460° to 510° C. for 1 to 4 hours and then cooled with water. Thereafter, the spring retainer is subjected to an aging at 210° to 240° C. for 0.5 to 4.0 hours.

(c) Two Stage Aging (First stage: Aging at Room Temperature)

The spring retainer is heated at 460° to 510° C. for 1 to 4 hours and then cooled with water. Thereafter, the spring retainer is subjected to an aging at room temperature for 4 days. After this aging at room temperature, the spring retainer is subjected to an aging at 210° to 240° C. for 0.5 to 4.0 hours.

(d) Two Stage Aging (First stage: Artificial Aging)

The spring retainer is heated at 460° to 510° C. for 1 to 4 hours and then cooled with water. Thereafter, the spring retainer is subjected to aging at 150° to 200° for 0.5 to 4.0 hours.

After such artificial aging, the spring retainer is subjected to an aging at 210° to 240° C. for 0.5 to 4.0 hours.

What is claimed is:

1. A valve spring retainer of a poppet valve operating mechanism for an internal combustion engine, comprising:

a matrix formed from a quenched and solidified aluminum alloy powder; and a hard grain dispersed in said matrix;

said hard grain being at least one selected from the group consisting of grains of $Al_2O_3$, SiC, $Si_3N_4$, $ZrO_2$, $SiO_2$, $TiO_2$, $Al_2O_3$—$SiO_2$ and metal Si;

the amount of hard grain added being in a range of from 0.5% to 20% by weight; and the area rate of said hard grain being in a range of from 1% to 6%.

2. A valve spring retainer of a poppet valve operating mechanism for an internal combustion engine according to claim 1, wherein the average particle size D of said hard grain is set such that $3\ \mu m \leqq D \leqq 30\ \mu m$; the hardness Hv of said hard grain is set such that $700 \leqq Hv < 1{,}000$, and when $K=(L+0.5)(D-1)$ in said range of the hardness Hv wherein the amount of hard grain added is represented by L, $200<K\leqq 600$ is established.

3. A valve spring retainer of a poppet valve operating mechanism for an internal combustion engine according to claim 1, wherein the average particle size D of said hard grain is set such that $3\ \mu m\leqq D\leqq 30\ \mu m$; the hardness Hv of said hard grain is set such that $1{,}000\leqq Hv<1{,}500$, and when $K=(L+0.5)\ (D-1)$ in said range of the hardness Hv wherein the amount of hard grain added is represented by L, $80<K\leqq 200$ is established.

4. A valve spring retainer of a poppet valve operating mechanism for an internal combustion engine according to claim 1, wherein the average particle size D of said hard grain is set such that $3\ \mu m\leqq D\leqq 30\ \mu m$; the hardness Hv of said hard grain is set such that $1{,}500\leqq Hv<2{,}000$, and when $K=(L+0.5)\ (D-1)$ in said range of the hardness Hv wherein the amount of hard grain added is represented by L, $35<K\leqq 80$ is established.

5. A valve spring retainer of a poppet valve operating mechanism for an internal combustion engine according to claim 1, wherein the average particle size D of said hard grain is set such that $3\ \mu m\leqq D\leqq 30\ \mu m$; the hardness Hv of said hard grain is set such that $2{,}000\leqq Hv\leqq 3{,}000$, and when $K=(L+0.5)\ (D-1)$ in said range of the hardness Hv wherein the amount of hard grain added is represented by L, $13\leqq K\leqq 35$ is established.

6. A valve spring retainer of a poppet valve operating mechanism for an internal combustion engine according to claim 1, 2, 3, 4 or 5, wherein said retainer includes a flange portion at one end of an annular base portion and having a larger diameter than that of the base portion, with an annular end face of said flange portion serving as an outer seat surface for carrying an outer valve spring and with an annular face end of said base portion serving as an inner seat surface for carrying an inner valve spring, the flow pattern of the fiber structure of a material in a surface layer region having said outer seat surface being substantially parallel to said outer seat surface.

7. A valve spring retainer of a poppet valve operating mechanism for an internal combustion engine according to claim 6, wherein the ratio a/b of the area rate a of said hard grain on said outer seat surface to the area rate b of said hard grain on said inner seat surface is set such that $1.05\leqq a/b\leqq 1.50$.

8. A valve spring retainer of a poppet valve operating mechanism for an internal combustion engine according to claim 7, wherein the flow pattern of the fiber structure of the material in said surface layer region is continuous with the axial flow pattern of the fiber structure of the material in the surface layer region of the base portion.

9. A valve spring retainer of a poppet valve operating mechanism for an internal combustion engine according to claim 8, wherein said base portion has an annular projection provided thereon and projecting from an inner peripheral edge of said inner seat surface, and wherein if the axial length between an outer end face of said flange portion and an outer end face of said projection is represented by L1, and the axial length between the outer end face of said flange portion and said inner seat surface is by L2, then $L2>\frac{1}{2}$ L2, and if the axial length between said outer seat surface and said inner seat surface is represented by L3; the axial length between the outer end face of said flange portion and said outer seat surface is by L4, and the axial length between the outer end face of said projection and said inner seat surface is by L5, then $L3>L4$, and $L3>L5$.

10. A valve spring retainer of a poppet valve operating mechanism for an internal combustion engine according to claim 9, wherein outer peripheral surfaces of both said base portion and said projection are formed into tapered surfaces convergent toward the outer end face of said projection.

11. A valve spring retainer of a poppet valve operating mechanism for an internal combustion engine according to claim 10, wherein the entire periphery of an opening at the outer face end of said projection in a valve stem mounting hole made through said flange portion, said base portion and said projection is rounded.

12. A valve spring retainer of a poppet valve operating mechanism for an internal combustion engine, comprising a matrix consisting of 12.0% by weight $\leqq$ Si $\leqq$ 28.0% by weight;
0.8% by weight $\leqq$ Cu $\leqq$ 5.0% by weight;
0.3% by weight $\leqq$ Mg $\leqq$ 3.5% by weight;
2.0% by weight $\leqq$ Fe $\leqq$ 10.0% by weight;
0.5% by weight $\leqq$ Mn $\leqq$ 2.9% by weight; and
the balance of aluminum including unavoidable impurities, and a hard grain dispersed in said matrix, said hard grain being at least one selected from the group consisting of grains of $Al_2O_3$, SiC, $Si_3N_4$, $ZrO_2$, $SiO_2$, $TiO_2$, $Al_2O_3$—$SiO_2$ and metal Si, the amount of hard grain added being in a range of from 0.5% by weight to 20% by weight, the area rate of said hard grain being in a range of from 1% to 6%.

13. A valve spring retainer of a poppet valve operating mechanism for an internal combustion engine according to claim 12, wherein the average particle size D of said hard grain is set such that $3\ \mu m\leqq D\leqq 30\ \mu m$; the hardness Hv of said hard grain is set such that $700\leqq Hv<1{,}000$, and when $K=(L+0.5)\ (D-1)$ in said range of the hardness Hv wherein the amount of hard grain added is represented by L, $200<K\leqq 600$ is established.

14. A valve spring retainer of a poppet valve operating mechanism for an internal combustion engine according to claim 12, wherein the average particle size D of said hard grain is set such that $3\ \mu m\leqq D\leqq 30\ \mu m$; the hardness Hv of said hard grain is set such that $1{,}000\leqq Hv<1{,}500$, and when $K=(L+0.5)\ (D-1)$ in said range of the hardness Hv wherein the amount of hard grain added is represented by L, $80<K\leqq 200$ is established.

15. A valve spring retainer of a poppet valve operating mechanism for an internal combustion engine according to claim 12, wherein the average particle size D of said hard grain is set such that $3\ \mu m\leqq D\leqq 30\ \mu m$; the hardness Hv of said hard grain is set such that $1{,}500\leqq Hv<2{,}000$, and when $K=(L+0.5)\ (D-1)$ in said range of the hardness Hv wherein the amount of hard grain added is represented by L, $35<K\leqq 80$ is established.

16. A valve spring retainer of a poppet valve operating mechanism for an internal combustion engine according to claim 12, wherein the average particle size D of said hard grain is set such that $3\ \mu m\leqq D\leqq 30\ \mu m$; the hardness Hv of said hard grain is set such that $2{,}000\leqq Hv\leqq 3{,}000$, and when $K=(L+0.5)\ (D-1)$ in said range of the hardness Hv wherein the amount of hard grain added is represented by L, $13 \leqq K \leqq 35$ is established.

17. A valve spring retainer of a poppet valve operating mechanism for an internal combustion engine according to claim 12, 13, 14, 15 or 16, wherein said retainer includes a flange portion at one end of an annular base portion and having a larger diameter than that of the base portion, with an annular end face of said flange portion serving as an outer seat surface for carrying an outer valve spring and with an annular face end of said base portion serving as an inner seat surface for carrying an inner valve spring, the flow pattern of the fiber structure of a material in a surface layer region having said outer seat surface being substantially parallel to said outer seat surface.

18. A valve spring retainer of a poppet valve operating mechanism for an internal combustion engine according to claim 17, wherein the ratio a/b of the area rate a of said hard grain on said outer seat surface to the area rate b of said hard grain on said inner seat surface is set such that $1.05 \leqq a/b \leqq 1.50$.

19. A valve spring retainer of a poppet valve operating mechanism for an internal combustion engine according to claim 18, wherein the flow pattern of the fiber structure of the material in said surface layer region is continuous with the axial flow pattern of the fiber structure of the material in the surface layer region of the base portion.

20. A valve spring retainer of a poppet valve operating mechanism for an internal combustion engine according to claim 19, wherein said base portion has an annular projection provided thereon and projecting from an inner peripheral edge of said inner seat surface, and wherein if the axial length between an outer end face of said flange portion and an outer end face of said projection is represented by L1, and the axial length between the outer end face of said flange portion and said inner seat surface is by L2, then $L2 > \frac{1}{2}$ L2, and if the axial length between said outer seat surface and said inner seat surface is represented by L3; the axial length between the outer end face of said flange portion and said outer seat surface is by L4, and the axial length between the outer end face of said projection and said inner seat surface is by L5, then L3>L4, and L3>L5.

21. A valve spring retainer of a poppet valve operating mechanism for an internal combustion engine according to claim 20, wherein outer peripheral surfaces of both said base portion and said projection are formed into tapered surfaces convergent toward the outer end face of said projection.

22. A valve spring retainer of a poppet valve operating mechanism for an internal combustion engine according to claim 21, wherein the entire periphery of an opening at the outer face end of said projection in a valve stem mounting hole made through said flange portion, said base portion and said projection is rounded.

23. A valve spring retainer of a poppet valve operating mechanism for an internal combustion engine, which is formed from a quenched and solidified aluminum alloy containing 0.2% to 4% by weight of at least one hydride forming constituent selected from the group consisting of Ti, Zr, Co, Pd and Ni.

24. A valve spring retainer of a poppet valve operating mechanism for an internal combustion engine, which is formed from a quenched and solidified aluminum alloy containing 12.0% to 28.0% by weight of Si; 0.8% to 5.0% by weight of Cu; 0.3% to 3.5% by weight of Mg; 2.0% to 10.0% by weight of Fe; 0.5% to 2.9% by weight of Mn; and 0.2% to 4% by weight of at least one hydride forming constituent selected from the group consisting of Ti, Zr, Co, Pd and Ni.

25. A valve spring retainer of a poppet valve operating mechanism for an internal combustion engine, comprising a matrix formed from a quenched and solidified aluminum alloy containing 12.0% to 28.0% by weight of Si; 0.8% to 5.0% by weight of Cu; 0.3% to 3.5% by weight of Mg; 2.0% to 10.0% by weight of Fe; 0.5% to 2.9% by weight of Mn; and 0.2% to 4% by weight of at least one hydride forming constituent selected from the group consisting of Ti, Zr, Co, Pd and Ni, and a hard grain dispersed in said matrix;

said hard grain being at least one selected from the group consisting of grains of $Al_2O_3$, SiC, $Si_3N_4$, $ZrO_2$, $SiO_2$, $TiO_2$, $Al_2O_3$-$SiO_2$ and metal Si;

the amount of hard grain added being in a range of from 0.5% to 20% by weight;

the area rate of said hard grain being in a range of from 1% to 6%.

26. A valve spring retainer of a poppet valve operating mechanism for an internal combustion engine according to claim 25, wherein the average particle size D of said hard grain is set such that $3\ \mu m \leqq D \leqq 30\ \mu m$; the hardness Hv of said hard grain is set such that $700 \leqq Hv < 1{,}000$, and when $K=(L+0.5)\ (D-1)$ in said range of the hardness Hv wherein the amount of hard grain added is represented by L, $200 < K \leqq 600$ is established.

27. A valve spring retainer of a poppet valve operating mechanism for an internal combustion engine according to claim 25, wherein the average particle size D of said hard grain is set such that $3\ \mu m \leqq D \leqq 30\ \mu m$; the hardness Hv of said hard grain is set such that $1{,}000 \leqq Hv < 1{,}500$, and when $K=(L+0.5)\ (D-1)$ in said range of the hardness Hv wherein the amount of hard grain added is represented by L, $80 < K \leqq 200$ is established.

28. A valve spring retainer of a poppet valve operating mechanism for an internal combustion engine according to claim 25, wherein the average particle size D of said hard grain is set such that $3\ \mu m \leqq D \leqq 30\ \mu m$; the hardness Hv of said hard grain is set such that $1{,}500 \leqq Hv < 2{,}000$, and when $K=(L+0.5)\ (D-1)$ in said range of the hardness Hv wherein the amount of hard grain added is represented by L, $35 < K \leqq 80$ is established.

29. A valve spring retainer of a poppet valve operating mechanism for an internal combustion engine according to claim 25, wherein the average particle size D of said hard grain is set such that $3\ \mu m \leqq D \leqq 30\ \mu m$; the hardness Hv of said hard grain is set such that $2{,}000 \leqq Hv \leqq 3{,}000$, and when $K=(L+0.5)\ (D-1)$ in said range of the hardness Hv wherein the amount of hard grain added is represented by L, $13 \leqq K \leqq 35$ is established.

30. A valve spring retainer of a poppet valve operating mechanism for an internal combustion engine according to claim 25, 26, 27, 28 or 29, wherein said retainer includes a flange portion at one end of an annular base portion and having a larger diameter than that of the base portion, with an annular end face of said flange portion serving as an outer seat surface for carrying an outer valve spring and with an annular face end of said base portion serving as an inner seat surface for carrying an inner valve spring, the flow pattern of the fiber structure of a material in a surface layer region having said outer seat surface being substantially parallel to said outer seat surface.

31. A valve spring retainer of a poppet valve operating mechanism for an internal combustion engine according to claim 30, wherein the ratio a/b of the area rate a of said hard grain on said outer seat surface to the area rate b of said hard grain on said inner seat surface is set such that $1.05 \leqq a/b \leqq 1.50$.

32. A valve spring retainer of a poppet valve operating mechanism for an internal combustion engine according to claim 31, wherein the flow pattern of the fiber structure of the material in said surface layer region is continuous with the axial flow pattern of the fiber structure of the material in the surface layer region of the base portion.

33. A valve spring retainer of a poppet valve operating mechanism for an internal combustion engine according to claim 32, wherein said base portion has an annular projection provided thereon and projecting from an inner peripheral edge of said inner seat surface, and wherein if the axial length between an outer end face of said flange portion and an outer end face of said projection is represented by L1, and the axial length between the outer end face of said flange portion and said inner seat surface is by L2, then $L2 > \frac{1}{2}$ L2, and if the axial length between said outer seat surface and said inner seat surface is represented by L3; the axial length between the outer end face of said flange portion and said outer seat surface is by L4, and the axial length between the outer end face of said projection and said inner seat surface is by L5, then $L3 > L4$, and $L3 > L5$.

34. A valve spring retainer of a poppet valve operating mechanism for an internal combustion engine according to claim 33, wherein outer peripheral surfaces of both said base portion and said projection are formed into tapered surfaces convergent toward the outer end face of said projection.

35. A valve spring retainer of a poppet valve operating mechanism for an internal combustion engine according to claim 34, wherein the entire periphery of an opening at the outer face end of said projection in a valve stem mounting hole made through said flange portion, said base portion and said projection is rounded.

36. In a mechanism for an internal combustion engine, said mechanism including a slide member subjected to sliding wear, an improved slide member comprising:

a matrix formed from an aluminum alloy consisting of
12.0% by weight $\leqq$ Si $\leqq$ 28.0% by weight;
0.8% by weight $\leqq$ Cu $\leqq$ 5.0% by weight;
0.3% by weight $\leqq$ Mg $\leqq$ 3.5% by weight;
2.0% by weight $\leqq$ Fe $\leqq$ 10. % by weight;
0.5% by weight $\leqq$ Mn $\leqq$ 2.9% by weight; and
the balance of aluminum including unavoidable impurities, and a hard grain dispersed in said matrix, said hard grain being at least one selected from the group consisting of grains of $Al_2O_3$, SiC, $Si_3N_4$, $ZrO_2$, $SiO_2$, $TiO_2$, $Al_2O_3SiO_2$ and metal Si, the amount of hard grain added being in a range of from 0.5% by weight to 20% by weight, the area rate of said hard grain being in a range of from 1% to 6%.

37. A slide member according to claim 36, wherein the average particle size D of said hard grain is set such that 3 μm $\leqq$ D $\leqq$ 30 μm; the hardness Hv of said hard grain is set such that $700 \leqq Hv < 1{,}000$, and when $K = (L + 0.5)(D - 1)$ in said range of the hardness Hv wherein the amount of hard grain added is represented by L, $200 < K \leqq 600$ is established.

38. A slide member according to claim 36, wherein the average particle size D of said hard grain is set such that 3 μm $\leqq$ D $\leqq$ 30 μm; the hardness Hv of said hard grain is set such that $1{,}000 \leqq Hv < 1{,}500$, and when $K = (L + 0.5)(D - 1)$ in said range of the hardness Hv wherein the amount of hard grain added is represented by L, $80 < K \leqq 200$ is established.

39. A slide member according to claim 36, wherein the average particle size D of said hard grain is set such that 3 μm $\leqq$ D $\leqq$ 30 μm; the hardness Hv of said hard grain is set such that $1{,}500 \leqq Hv < 2{,}000$, and when $K = (L + 0.5)(D - 1)$ in said range of the hardness Hv wherein the amount of hard grain added is represented by L, $35 < K \leqq 80$ is established.

* * * * *